US009214269B2

(12) United States Patent
Samala et al.

(10) Patent No.: US 9,214,269 B2
(45) Date of Patent: Dec. 15, 2015

(54) IC RECTANGULAR INDUCTOR WITH PERPENDICULAR CENTER AND SIDE SHIELD TRACES

(71) Applicants: Sreekiran Samala, Richardson, TX (US); Daryl Barry, Plano, TX (US)

(72) Inventors: Sreekiran Samala, Richardson, TX (US); Daryl Barry, Plano, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 14/101,297

(22) Filed: Dec. 9, 2013

(65) Prior Publication Data

US 2014/0159854 A1 Jun. 12, 2014

Related U.S. Application Data

(60) Provisional application No. 61/735,188, filed on Dec. 10, 2012.

(51) Int. Cl.
*H01F 27/32* (2006.01)
*H01F 27/28* (2006.01)
*H01F 17/00* (2006.01)

(52) U.S. Cl.
CPC ..... *H01F 17/0006* (2013.01); *H01F 2017/008* (2013.01); *H01F 2017/0046* (2013.01)

(58) Field of Classification Search
CPC ..... H01F 17/0013; H01F 17/0006; H01F 2017/008; H01F 2017/0046; H01F 27/2804; H01F 27/2847; H01F 27/288; H01F 27/2885; H01F 27/36; H01F 27/362; H01F 27/365
USPC ..... 336/84 C, 232, 200
See application file for complete search history.

(56) References Cited

U.S. PATENT DOCUMENTS

| | | | | |
|---|---|---|---|---|
| 6,833,603 | B1 * | 12/2004 | Park et al. | 257/528 |
| 7,564,319 | B2 * | 7/2009 | Ding et al. | 331/181 |
| 2002/0084509 | A1 * | 7/2002 | Ballantine et al. | 257/531 |
| 2006/0049481 | A1 * | 3/2006 | Tiemeijer et al. | 257/531 |
| 2006/0163692 | A1 * | 7/2006 | Detecheverry et al. | 257/531 |
| 2011/0050383 | A1 * | 3/2011 | Tiemeijer | 336/226 |

* cited by examiner

*Primary Examiner* — Mangtin Lian
(74) *Attorney, Agent, or Firm* — Lawrence J. Bassuk; Frank D. Cimino

(57) ABSTRACT

An inductive device is provided, which includes a substrate, a layer having a plurality of conductive metal traces and a metal shield layer. The conductive trace has an input port, a first portion, a second portion, a third portion and an output port. The metal shield layer is disposed between the substrate and the conductive trace. Each of the plurality of conductive metal traces has a respective length and a respective width. Each of the plurality of conductive metal traces are separated from one another. Each of the plurality of conductive metal traces are disposed perpendicularly with the first portion and the third portion. The metal shield layer provides spaced shield traces substantially perpendicular with the conductive metal traces.

4 Claims, 13 Drawing Sheets

FIG. 6
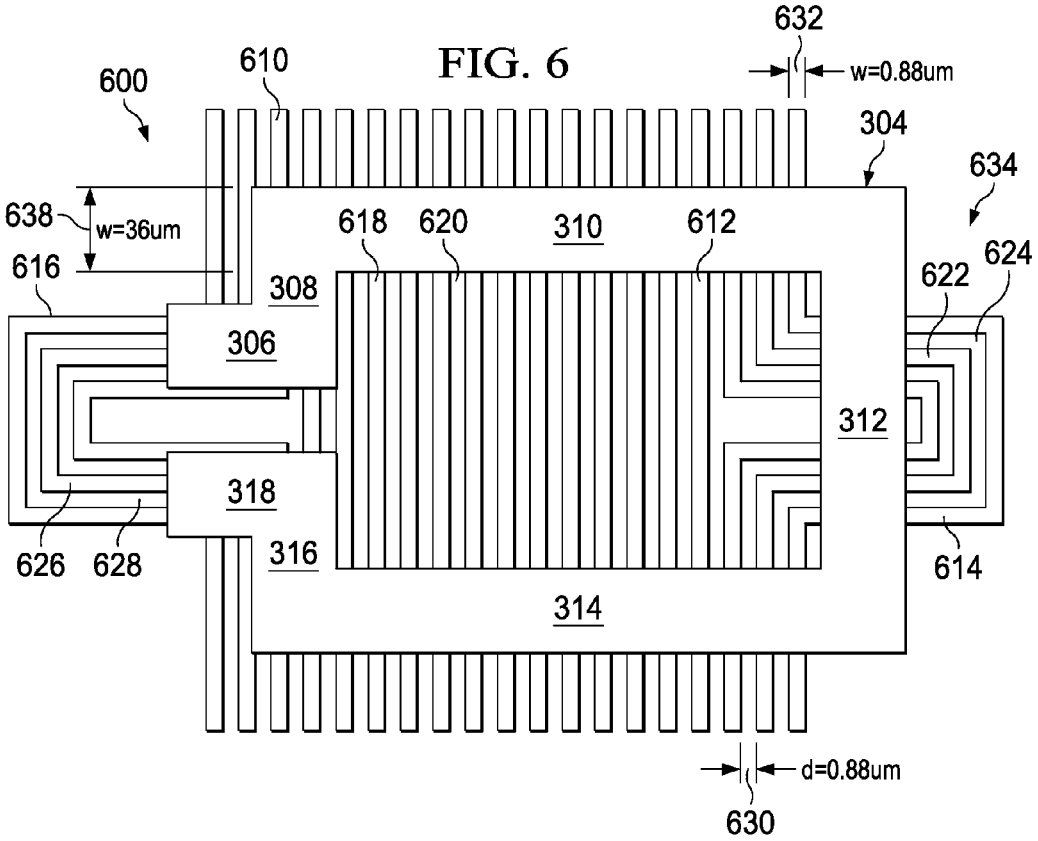
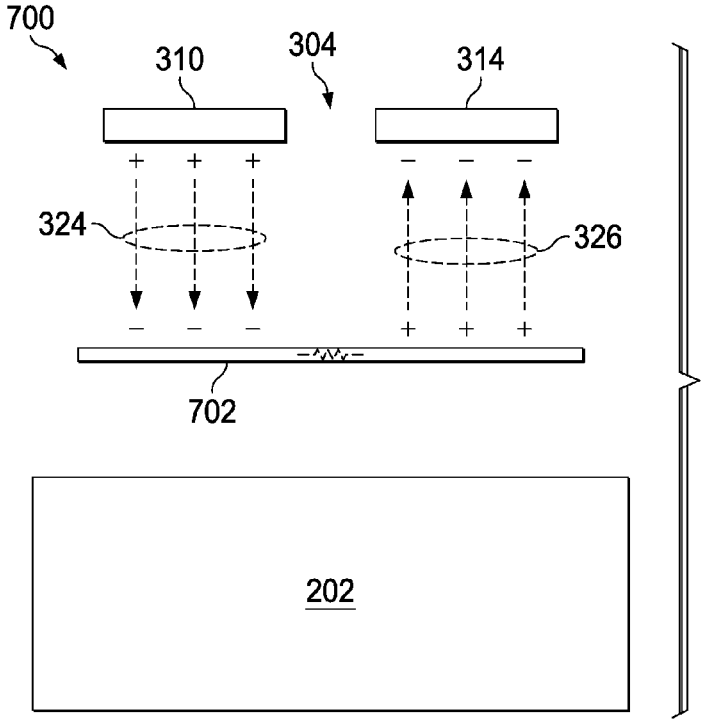
FIG. 7B

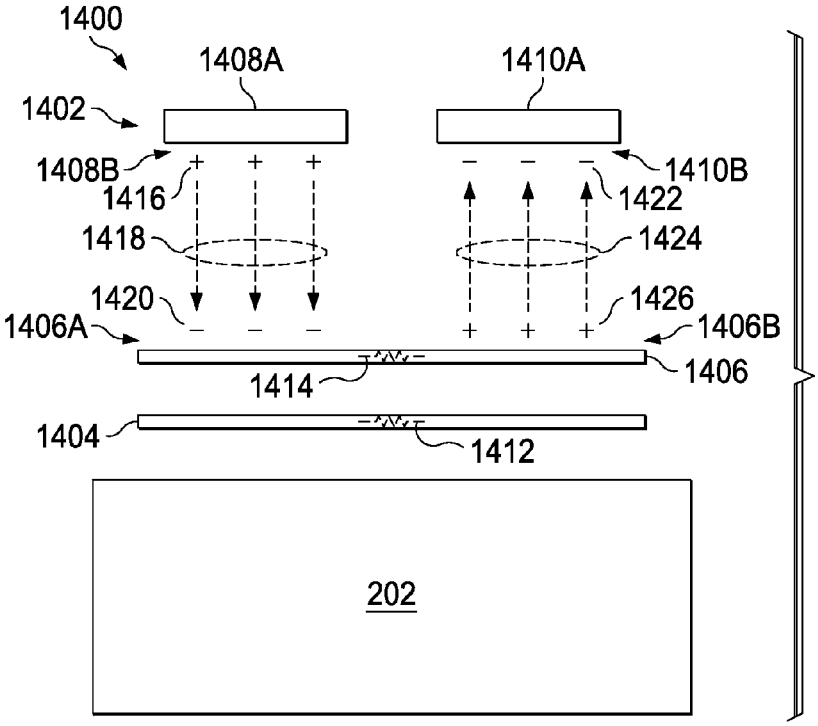
FIG. 14
FIG. 15
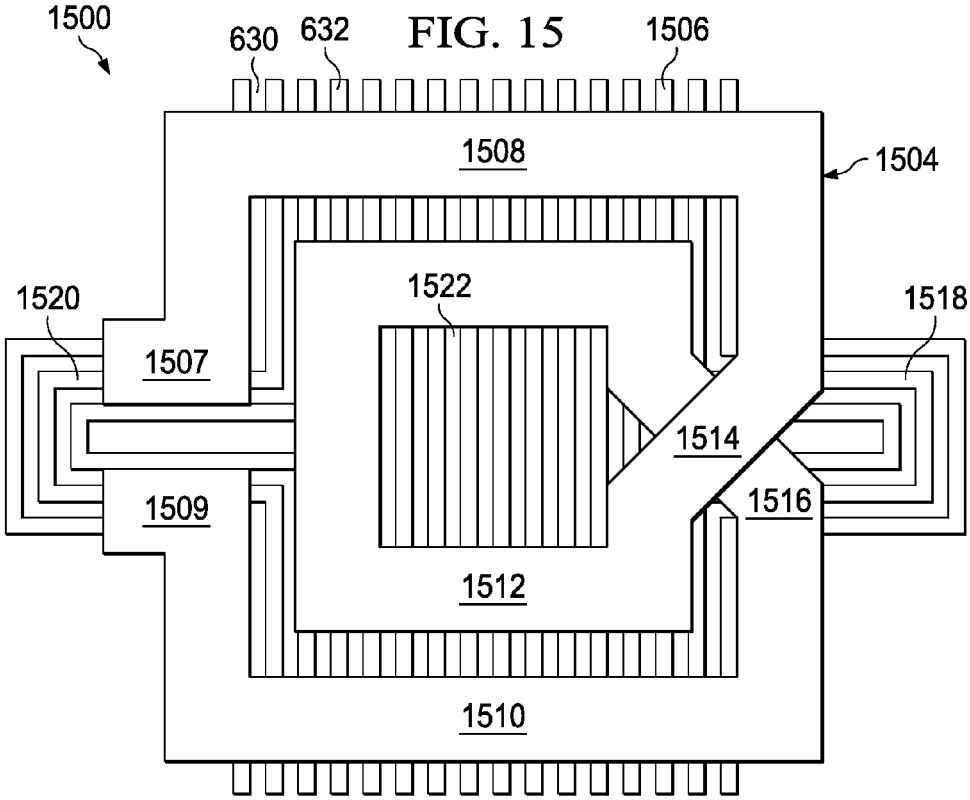

IC RECTANGULAR INDUCTOR WITH PERPENDICULAR CENTER AND SIDE SHIELD TRACES

The present application claims priority from: U.S. Provisional Application No. 61/735,188 filed Dec. 10, 2012, the entire disclosure of which is incorporated herein by reference.

BACKGROUND

The present invention generally relates to a planar inductor on a semiconductor device.

A conventional planar inductor on a semiconductor chip or integrated circuit is described.

FIG. 1 illustrates a conventional multi-turn planar inductor.

As shown in the figure, a planar inductor 100 includes a substrate 102, a dummy metal fill 104, an input 106, a crossover 108, a crossover 110, a cross-under 112, a cross-under 114, an output 116, a trace portion 118, a trace portion 120, a trace portion 122, a trace portion 124 and a trace portion 126.

Input 106 provides a connection to Trace portion 118. Trace portion 118 is disposed between input 106 and crossover 108. Trace portion 120 is disposed between crossover 108 to cross-under 112. Trace portion 122 is disposed between cross-under 112 and crossover 110. Trace portion 124 is disposed between crossover 110 and cross-under 114. Trace portion 126 is disposed between cross-under 114 and output 116.

In operation, a current is transmitted through planar inductor 100 causing a magnetic field to form perpendicular to planar inductor 100. Current enters at input 106, flows through trace portions of planar inductor 100, and exits at output 116. Trace portions of planar inductor 100 in conjunction with crossover 108, crossover 110, cross-under 112, and cross-under 114 allow multiple levels of trace portions to function as a coiled wire.

As current flows through the trace portions of planar inductor 100, the associated magnetic field generates additional electromagnetic fields, which will be described in greater detail with reference to FIG. 2.

FIG. 2 illustrates a partial cross sectional oblique view of a conventional planar inductor 200.

As shown in the figure, conventional planar inductor 200 includes a semiconducting substrate 202 and a trace 204. Trace 204 includes a trace portion 206, a trace portion 208 and a trace portion 210. Input and output ports (not shown) are parallel to trace portion 206 and trace portion 210 and are perpendicular to trace portion 208. A positive charge 212, a negative charge 214, an image current 216, an electric field 218, an electric field 220, a current 222 and a magnetic flux 223 are additionally included in the figure.

In operation, current 222 enters at input (not shown) at proximal end of trace portion 206, travels from trace portion 206 to trace portion 208 and exits at output (not shown) at proximal end of trace portion 210. Current 222, flowing through trace 204, will generate a magnetic flux 223 between trace portion 206 and trace portion 210, which flows in au inward direction toward substrate 202. According to Lenz's law magnetic flux 223 causes circular eddy currents in substrate 202 that generate a magnetic flux (not shown) in a direction opposite to that of magnetic flux 223. Since the substrate is not extremely conductive and has a relatively small resistivity, the eddy current losses are small.

Positive charge 212 and negative charge 210 are illustrated as a current differential at a time $t_0$ in order to show a direction of current 222. Positive charge 212 generates a spherically radiating electric field. The portion of the spherically radiating electric field, which is of interest, is that which is directed toward substrate 202, and is indicated as electric field 218. Electric field 218 then induces a negative charge on substrate 202.

Similarly, negative charge 214 additionally generates a spherically radiating electric field in the opposite direction of the spherically radiating electric field associated with positive charge 212. The portion of the spherically radiating electric field of negative charge 214, which is of interest, is that which is directed from substrate 202, and is indicated as electric field 220. Electric field 220 then induces a positive charge on substrate 202.

In this manner, the positive charge induced by electric field 220 and the negative charge induced by electric field 218 create image current 216, flowing in an opposite direction to current 222 within substrate 202. Image current 216 is smaller in magnitude than current 222 and rotates in a direction opposite to that of current 222 within trace 204.

For purposes of discussion, consider the example where the resistance of substrate 202 is around 12.5 Ωcm. This is not too high or too low. Since substrate 202 is not extremely conductive, the eddy current losses will be negligible as described earlier. Image current 216, when flowing in substrate 202, leads to resistive dissipation losses ($I^2R$ loss). Since Q is a function of the ratio of energy stored in magnetic flux to the energy dissipated, the resistive loss from substrate 202 leads to Q degradation. In order to minimize the substrate loss due to image currents, substrate 200 needs to be made highly conductive or highly resistive.

The quality factor (or Q factor) of an inductor is the ratio of its inductive reactance to its resistance at a given frequency, and is a measure of its efficiency. The higher the Q factor of the inductor, the closer it approaches the behavior of an ideal, lossless, inductor. The inductive reactance of an inductor is based on the overall generated magnetic flux. In the case of planar inductor 200, the overall magnetic flux is a combination of-magnetic flux 223 generated by current 222 and the magnetic flux (not shown) generated by image current 216 in substrate 202. For example, a conventional planar inductor similar to planar inductor 200 may provide a Q factor in the range of 10 to 16.

In order to make the substrate highly conductive one conventional method uses a blanket metal shield, and will now be explained with reference to FIGS. 3A-B.

FIG. 3A illustrates a top view of a conventional planar inductor 300.

As shown in the figure, conventional planar inductor 300 includes a blanket metal shield 302, a substantially rectangular trace 304, and a substrate (not shown). Trace 304 includes a trace portion 306, a trace portion 308, a trace portion 310, a trace portion 312, a trace portion 314, a trace portion 316, and a trace portion 318.

Blanket metal shield 302 is disposed between trace 304 and the substrate (not shown). Trace portions 306 is parallel to trace portion 318, whereas trace portion 310 is parallel to trace portion 314. Trace portions 308 and 316 are parallel to trace portion 312. Trace portions 310 and 314 are perpendicular to trace portions 308, 312, and 316.

In operation, current flows through trace portions of planar inductor 304. Trace portion 314 and trace portion 316 serve as input and output. Blanket metal shield 302 forms a conductive layer disposed between substrate (not shown) and trace 304. In FIG. 2, an inductor with trace disposed on semiconducting substrate, without shield, induces an image current within substrate. The resistive losses in the substrate (not shown), due to the flow of this image current, cause the Q to degrade. FIG. 3B illustrates a partial cross sectional oblique view of conventional planar inductor 300. This figure describes certain aspects of electrical and magnetic behavior of planar inductor 300.

As shown in FIG. 3B, conventional planar inductor 300 includes substrate 202, trace 304, and blanket metal shield 302.

Additionally shown in the figure are positive charge 320, negative charge 322, electric field 324, electric field 326, current 328, eddy currents 330 and a magnetic flux 332.

In operation, current 328 enters through input (not shown) at proximal end of trace portion 310, travels through trace portion 310 to trace portion 312 and exits at output (not shown) at proximal end of trace portion 314. Current 328, traveling in a circular manner, will generate magnetic flux 332 that is between trace portion 310 and trace portion 314, which flows in an inward direction toward substrate 202.

Similarly to planar inductor 200 of FIG. 2, a positive charge on trace portion 310 of planar inductor 300 will induce a negative charge on blanket metal shield 302. Similarly, a negative charge on trace portion 314 will induce a positive charge on blanket metal shield 302. In contrast with planar inductor 200, because blanket metal shield 302 is a metal shield, it conducts the induced positive and negative charges induced thereon. These charges cause an image current to flow in a direction opposite to the current in trace 304. Since blanket metal shield 302 is highly conductive, the image current leads to negligible $I^2R$ resistive losses. Disposing an intermediate conductive shield between trace and substrate reduces Q degradation due to resistive losses due to image current within substrate.

However, magnetic flux 332 generates eddy currents 330 within blanket metal shield 302. Since blanket metal shield 302 is highly conductive the eddy currents 330 are large and comparable to current 328. These eddy currents 330 generate associated magnetic flux that are opposite in direction and comparable in magnitude, and which counter magnetic flux 332. In the case of planar inductor 300, the overall magnetic flux is a sum of magnetic flux 332 generated by current 328 and a large opposite magnetic flux (not shown) induced by eddy currents in blanket metal shield 302. Accordingly, the Q factor is severely attenuated by the presence of eddy currents within blanket shield.

In planar inductor 200 of FIG. 2, the Q factor is diminished as a result of the image currents generated in the lossy substrate 200. In planar inductor 300 of FIG. 3B, blanket metal shield 302 prevents image currents from forming within lossy substrate 202. However, in planar inductor 300 of FIG. 3B, the Q factor is diminished as a result of large eddy currents generated in blanket metal shield 302.

A metal shield disposed between trace and substrate eliminates image currents within substrate but induces eddy currents due to charges generated within conductive shield material. Eddy currents exist more readily within a conductive material where charges can move more freely than in a semiconductor or insulator material. Conventional efforts attempt to reduce losses in Q factor of planar inductor by using a patterned metal ground shield to minimize eddy currents in the conductive shield and minimize image currents in the lossy silicon substrate. This conventional slotted planar inductor will now be explained with reference to FIG. 4.

FIG. 4 illustrates a top view of a conventional planar inductor 400.

As shown in the figure, conventional planar inductor 400 includes a substrate (not shown), trace 304 and a randomly-traced metal shield 402. Metal shield 402 includes a shield portion 404, a shield portion 406, a shield portion 408, and a shield portion 410. Metal shield 402 is disposed between a substrate (not shown) and trace 304.

Shield portion 404 includes a plurality of parallel traces arranged to resemble stripes. The traces are very closely spaced and have different lengths, a sample of which is indicated as a trace 412. Shield portion 406 includes a plurality of parallel traces arranged to resemble stripes. The traces are very closely spaced and have different lengths, a sample of which is indicated as a trace 414. Shield portion 408 includes a plurality of parallel traces arranged to resemble stripes. The traces are very closely spaced and have different lengths, a sample of which is indicated as a trace 416. Shield portion 410 includes a plurality of parallel traces arranged, to resemble stripes. The traces are very closely spaced and have different lengths, a sample of which is indicated as a trace 418.

The parallel traces of shield portion 404 are arranged such that the length of each trace is parallel with the length of each of parallel traces of shield portion 408. The parallel traces of shield portion 404 are additionally arranged such that the length of each trace is perpendicular with the length of each of parallel traces of shield portion 418. The parallel traces of shield portion 404 are additionally arranged, such that the length of each trace is perpendicular with the length of each of parallel traces of shield portion 406.

Metal shield 402 is disposed between trace 304 and substrate (not shown).

A portion, indicated by dotted trapezoid 420, of the plurality of parallel traces of shield portion 408 are perpendicular to trace portion 314. A portion, indicated by dotted five-sided object 422, of the plurality of parallel traces of shield portion 406 are parallel to trace portion 314. Further, a portion, indicated by dotted five-sided object 424, of the plurality of parallel traces of shield portion 410 are parallel to trace portion 314.

A portion, indicated by dotted trapezoid 426, of the plurality of parallel traces of shield portion 404 are perpendicular to trace portion 310. A portion, indicated by dotted five-sided object 430, of the plurality of parallel traces of shield portion 406 are parallel to trace portion 310. Further, a portion, indicated by dotted five-sided object 428, of the plurality of parallel traces of shield portion 410 are parallel to trace portion 310.

In operation, trace 304 in FIG. 4 performs a function equivalent to that of trace 304 in FIG. 3A. A shield 402 comprises distinct and separate conductive traces so that eddy currents are constrained within each trace and loss in Q factor is minimized.

Importantly, metal shield 402 in FIG. 4 contains very closely spaced traces that are randomly sized and randomly placed. Trace 412 is representative of traces in metal shield 402. The trace pattern (i.e., the width of the metal shield traces, the spacing between the metal shield traces, the length of the metal shield traced and the symmetry and orientation w.r.t main inductor shield) of shield portions 404, shield portion 406, shield portion 408, and shield portion 410 is randomly determined.

As the traces in metal shield are randomly spaced and randomly placed, there are portions within planar inductor 400 in which there is no blanket shield disposed between trace and substrate such as location 434, portions in which a metal shield is disposed between trace and substrate such as trace 404, and portions in which a metal shield is partially disposed between trace and substrate such as trace 414.

Portions without metal shield disposed between trace and substrate behave similarly to planar inductor 200 of FIG. 2. Electric fields in these locations terminate on substrate and generate image currents in lossy substrate similarly to planar inductor 200 of FIG. 2. Image currents then cause resistive losses in the substrate, which degrades Q factor of the inductor.

Portions of inductor 400 in which metal traces are disposed between trace and substrate behave similarly to FIG. 3B yet magnitude of eddy current is reduced. Metal shield 402 is slotted and not a solid blanket shield. Due to this, the conductive shield portion is constrained within the traces. Further, the corresponding eddy current loops are constrained within these small traces and do not form a big continuous loop. As such, the eddy current magnitude is reduced as compared to eddy currents within a blanket metal shield. The magnitude of magnetic flux 356 is reduced and degradation of Q factor due to eddy currents in the conductive shield is reduced In operation, planar inductor 400 contains aspects of planar inductor 200 of FIG. 2. Portions below trace 304 between traces of slotted metal shield 402 behave in a manner similar to planar inductor 200 of FIG. 2, where image currents are induced within substrate 202. Portions below trace 304 directly above traces of slotted metal shield 402 operate in a somewhat different manner, as will be described with additional reference to FIGS. 5A-B.

FIG. 5A illustrates a cross-sectional view of conventional planar inductor 400 with a randomly-traced shield, wherein the cross-section is disposed at a position such that the metal shield includes a centrally slotted shield portion.

As shown in the figure, conventional planar inductor 400 includes a cross sectional portion of trace 304 indicated as a trace portion 502, a cross sectional portion of metal shield 402 indicated as a metal shield portion 506 and substrate 202. Trace portion 502 includes a portion 502A with surface 502B, and a portion 504A with surface 504B. Metal shield portion 506 includes portion 506A with surface 506B and surface 506C and portion 508A with surface 508B and surface 508C.

Additionally shown in the figure are a positive charge 510, an electric field 512, a negative charge 514, a positive charge 516, an electric field 518, a negative charge 520, a negative charge 526, an electric field 528, a positive charge 530, a negative charge 532, an electric field 534 and a positive charge 536. Metal shield portion 506 is disposed between trace portion 502 and substrate 202.

FIG. 5A illustrates the location of charges and current for planar inductor 400 where portion 502A and portion 504A are separated by space 507. As current is applied to trace portion 502, positive charge 510 accumulates on surface 502B causing electric field 512 to flow towards portion 506A. Electric field 512 induces negative charge 514 to accumulate on surface 506B. Opposing positive charge 516 is induced on bottom surface 506C causing electric field 518 to flow toward surface 522, which induces negative charge 520 on substrate surface 522.

Similarly, as the (opposite) current is applied to trace portion 502, negative charge 526 accumulates on surface 504B causing electric field 528 to flow from shield portion 508A. Electric field 528 induces positive charge 530 to accumulate on surface 508B. An opposing negative charge 532 is induced on bottom surface 508C causing electric field 534 to flow from surface 538, which induces positive charge 536 on substrate surface 538.

As mentioned above, current flows through trace portion 502 such that it travels normal and into FIG. 5A at portion 502A and normal and out of FIG. 5A at portion 504A. This current flow is represented by positive charge 510 on surface 502B and by negative charge 526 on surface 504B. This current is mirrored, i.e., as an image current, on substrate 202 in light of the induced negative charge 520 and positive charge 536. Specifically, the image current flows through substrate 202 such that it travels normal and out of FIG. 5A at the surface of substrate 202 below portion 502A and normal and into FIG. 5A at the surface of substrate 202 below portion 504A. Negative charge 520 on substrate surface 522 and positive 536 on substrate surface 538 will be exactly identical to the case of the inductor having no metal shield between the main trace and substrate. So the image current will be of the same magnitude as the case when there is no metal shield between the main trace and substrate. This image current, when flowing in the lossy substrate, creates resistive $I^2R$ losses, represented by 540, leading to Q degradation. This Q degradation in this portion of the metal shield will be exactly identical to the case where there is no metal shield between the main trace and substrate. FIG. 5B illustrates a cross-sectional view of conventional planar inductor 400 with a randomly traced shield, wherein the cross-section is disposed at a position such that the metal shield includes an unbalanced slotted shield portion.

As shown in the figure, this portion of conventional planar inductor 400 includes a cross sectional portion of trace 304 indicated as trace portion 550, a cross sectional portion of metal shield 402 indicated as a shield portion 566A, and substrate 202. Trace portion 550 includes portion 552A and portion 554A. Portion 552A includes a surface 552B and portion 554A includes a surface 554B. Shield portion 566A includes a surface 556B, a surface 556C, a surface 556D and a surface 556E.

Additionally shown in the figure are a positive charge 558, an electric field 560, a negative charge 562, a positive charge 564, an electric field 566, a negative charge 568, a negative charge 572, an electric field 574, a positive charge 576, a positive charge 578, an electric field 580, and a positive charge 582.

Shield portion 566A is disposed between substrate 202 and trace portion 550 in an unbalanced distance between portions 552A and 552B.

This portion of conventional planar inductor 400 behaves similarly to conventional planar inductor 400 of FIG. 5A except that there is one shield portion 556A in FIG. 5B rather than two shield portions, 506A and 508A, in FIG. 5A. As current is applied to portion 552A, positive charge 558 accumulates on surface 552B causing electric field 560 to flow towards shield portion 556A. Electric field 560 induces negative charge 562 on surface 556B. Opposing positive charge 564 is induced on surface 556C causing electric field 566 to flow toward surface 570, which induces negative charge 568 on surface 570. For purposes of discussion, in FIG. 5B, three positive charges are illustrated as forming on surface 552B and three corresponding negative charges are illustrated as forming on surface 556B. However, only two positive charges are illustrated as forming on surface 556C and two corresponding negative charges are illustrated as forming on surface 570. The loss of a charge is a result of the charges induced by portion 554A, which will now be discussed.

Negative charge 572 accumulates on surface 554B of portion 554A causing a portion of electric field 574 to flow from a surface 584 of substrate 202 and a portion of electric field 574 to flow from a surface 556D of shield portion 556A. The portion of electric field 574 from shield portion 556A induces positive charge 576 on surface 556B. Positive charge 576 effectively cancels a induced negative charge from electric field 560 from portion 552A. It is this cancellation that results in the illustrated two positive charges on surface 556C. The remaining charges induced on surface 584 that are not under shield portion 556A do not affect charges on surface 556C. The portion of electric field 574 from surface 584 induces positive charges 578 and 582.

Since shield portion 556A extends from under portion 552A to portion 554A, electric field 560 and electric field 574 partially cancel, as shown in FIG. 5B. The remaining residual portion of electrical field 566 and electric field 580 create image currents in substrate 202. This image current, when flowing in the lossy substrate, creates resistive $I^2R$ losses, represented by 586, leading to Q degradation. This degradation in Q will be less than the case where there is no metal shield between the inductor and substrate.

In the places of planar inductor 400 where there is no shield located between trace 304 and substrate 202, the electric fields generated by trace 304 induce charges on the surface of substrate 202. In the places of planar inductor 400 where there is a balanced shield but not extending from a positive side to a negative side of planar inductor 400, located between trace 304 and substrate 202, for example as discussed above with reference to FIG. 5A, the electric fields generated by trace 304 induce charges on the surface of substrate 202, exactly equal to the case where there is no shield. In the places of planar inductor 400 where there is a unbalanced shield located between trace 304 and substrate 202, for example as discussed above with reference to FIG. 5B, the electric fields generated by trace 304 induce charges on the surface of substrate 202, albeit smaller than the case where there is a no shield. Also since the shield traces are placed extremely close to each other, at high frequencies of operation, the shield traces capacitively couple to each other leading to flow of eddy currents and hence leading to further Q degradation. The combination of instances of these situations produces an overall image current, which negatively affects the Q factor of planar inductor 400.

What is needed is an inductor with a higher Q factor and a variable frequency modulation.

BRIEF SUMMARY

The present invention provides a system and method for a planar inductor having a higher Q factor and a variable self-resonance frequency.

An aspect of the present invention provides an inductive device, which includes a substrate, a layer having a plurality of conductive metal traces and a conductive trace. The conductive trace has an input port, a first portion, a second portion, a third portion and an output port. The metal shield layer is disposed between the substrate and the conductive trace. Each of the plurality of conductive metal traces has a respective length and a respective width. Each of the plurality of conductive metal traces is separated from one another. Each of the plurality of conductive metal traces are disposed perpendicularly and symmetrically with respect to the first portion and third portion and are disposed continuously from below the first portion to below the third portion.

Additional advantages and novel features of the invention are set forth in part in the description which follows, and in part will become apparent to those skilled in the art upon examination of the following or may be learned by practice of the invention. The advantages of the invention may be realized and attained by means of the instrumentalities and combinations particularly pointed out in the appended claims.

BRIEF SUMMARY OF THE DRAWINGS

The accompanying drawings, which are incorporated in and form a part of the specification, illustrate an exemplary embodiment of the present invention and, together with the description, serve to explain the principles of the invention. In the drawings:

FIG. 6 illustrates a planar inductor in accordance with aspects of the present invention;

FIG. 7B explains the operation of the slotted metal shield of the planar inductor of FIG. 7A

FIG. 14 illustrates cross-sectional view of a tunable-frequency planar inductor in accordance with aspects of the present invention; and FIG. 15 illustrates a two-turn (2-T) planar inductor in accordance with aspects of the present invention.

DETAILED DESCRIPTION

Figure 1:
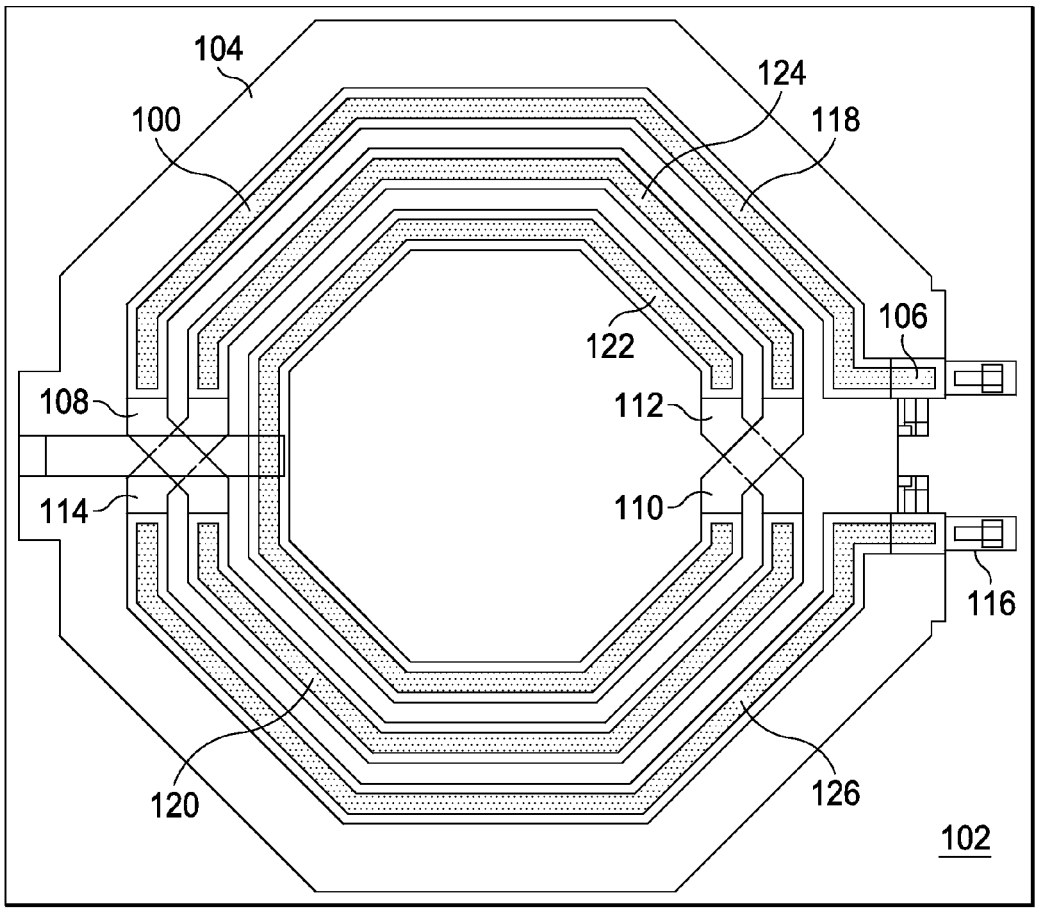
FIG. 1 (PRIOR ART)
FIG. 1 illustrates a conventional multi-turn planar inductor.

A first aspect of the present invention is drawn to a slotted metal shield in a planar inductor, wherein the slotted shield is arranged such that shield portions are arranged continuously, perpendicularly and symmetrically across two parallel portions of the trace. The shield portions reduce image currents in substrate, whereas the non-shield portions reduce the eddy currents in the shield portions. The arrangement of the alternating shield/non-shield portions of the slotted metal shield prevents image currents in the shield, while concurrently minimizing eddy currents in the shield. In example embodiments, the shield portions include metal strips disposed orthogonally to the direction of current flow in the main trace. Further, the metal strips extend continuously from the positive side of the main trace to the negative side of the main trace so as to balance the electrical fields, and ensuring that the electrical fields are confined between the shield and the main trace of the inductor. Such a structure provides an overall increased Q factor in the planar inductor.

A second aspect of the present invention is drawn to an additional switchable slotted metal shield in a planar inductor, wherein the additional switchable slotted metal shield is able to tune the resonant frequency of the planar inductor.

A first aspect of the present invention will now be described in greater detail with reference to FIGS. 6-8.

FIG. 6 illustrates an example planar inductor 600 in accordance with aspects of the present invention.

As shown in the figure, planar inductor 600 includes a substrate (not shown), trace 304, and a slotted metal shield 610. Slotted metal shield 610 is disposed between trace 304 and the substrate.

Trace 304 contains a dimension 638 which is the width of trace portion 308, and in this example, Trace 304 has a width w=36 μm. Trace portions 306, 310, 314, and 318 are parallel. Trace portions 308, 312 and 316 are parallel. Trace portions 306, 310, 314, and 318 are perpendicular to trace portions 308, 312, and 316.

Slotted metal shield 610 includes a center shield portion 612, a side shield portion 614 and a side shield portion 616. Center shield portion 612 contains a plurality of shield traces, an example of which is indicated as a shield trace 618 with trace-to-trace spacing 620. Side shield portion 614 contains a plurality of shield traces, an example of which is indicated as a shield trace 622 with trace-to-trace spacing 624. Side shield portion 616 contains a plurality of shield traces, an example of which is indicated as a shield trace 626 with trace-to-trace spacing 628. Shield portion 614 presents a portion 634 in which the shield traces and trace-to-trace spacing are continuous with the shield traces and trace-to-trace spacings respectively under trace portions 310 and 314.

Each shield trace is separated from its neighboring trace by a spacing 630 and has a width 632.

As shown in the figure, vertical portions of traces of slotted metal shield 610 are perpendicular to horizontal portions of trace 304, and vertical portions of traces of slotted metal shield 610 are parallel to each other. Similarly, horizontal portions of traces of slotted metal shield 610 are perpendicular to vertical portions of trace 304, and horizontal portions of traces of slotted metal shield 610 are parallel to each other. In this manner, portions of traces of slotted metal shield 610 are each perpendicular to the respective portion of trace 304 below which they are disposed.

In operation, current through trace 304 causes a magnetic field to form perpendicular to the surface of planar inductor 600. In planar inductor 600 of the present invention, a key difference is the use of slotted metal shield 600 for a higher Q factor.

Each of a plurality of shield traces in center shield portion 612 is perpendicular to trace portion 310 and trace portion 314. Each of another plurality of shield traces in shield portion 614 is non-linear and is perpendicular to trace portions 310, 312 and 314. Each of another plurality of shield traces in shield portion 616 is perpendicular to trace portions 306, 308, 316, and 318. In addition, traces of slotted metal shield 610 are continuous across facing trace portions of trace 304, eliminating imbalance as discussed above with reference to FIG. 5B. In should be noted that the example implementation illustrated in FIG. 6 does not include metal shield traces disposed orthogonally to the direction of current flow in the main trace near input portion 306 and output portion 318. However, input portion 306 and output portion 318 are short relative to the remaining portions of trace 304 and thus will not significantly degrade the Q factor.

A Q factor may be modified by changing shield trace spacing and shield trace width. In an example embodiment, width and spacing are defined as dimension 630, the spacing between adjacent shield traces, to be 0.88 μm and dimension 632, the width of a shield slot, to be 0.88 μm.

Figure 4:
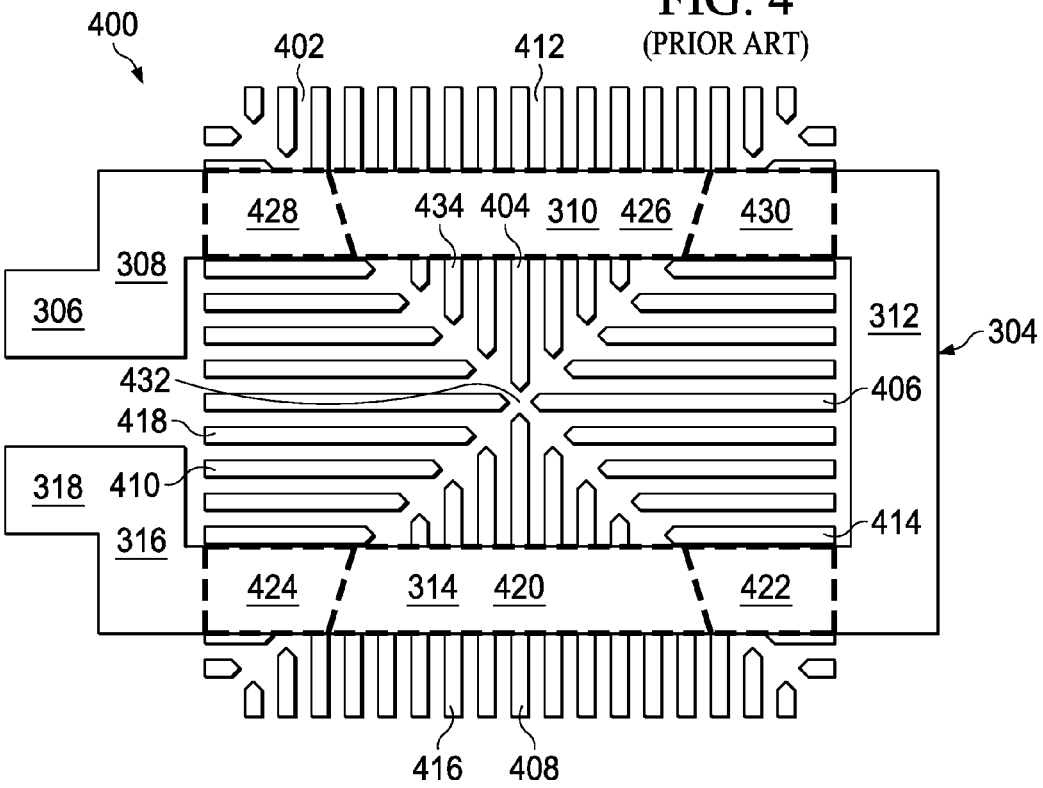
FIG. 4 (PRIOR ART)
FIG. 4 illustrates a top view of a conventional planar inductor.
Figure 5A:
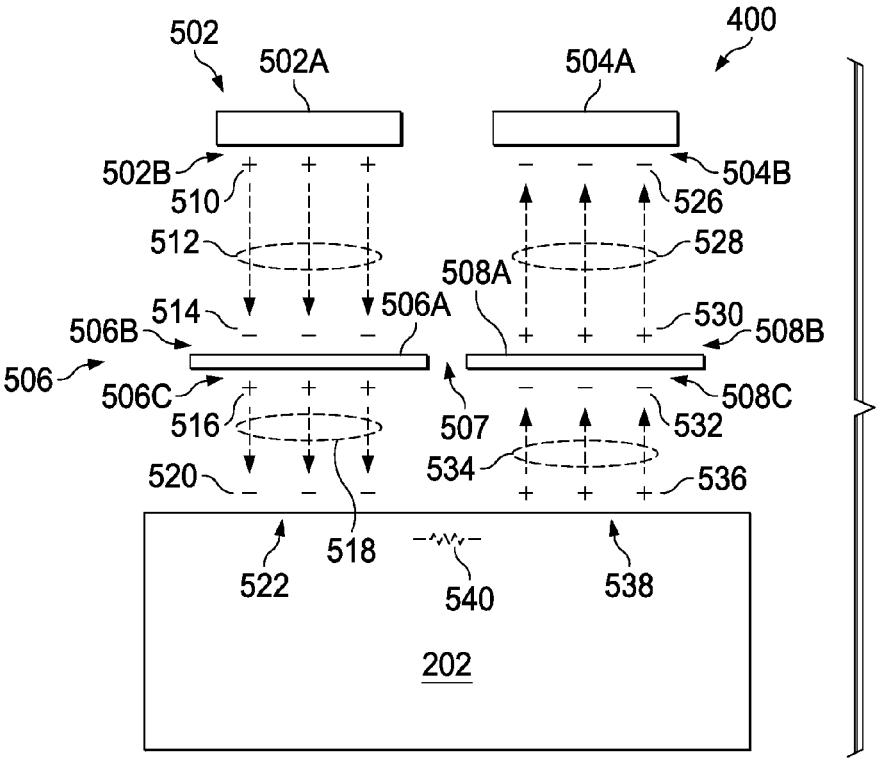
FIG. 5A (PRIOR ART)
FIG. 5A illustrates a cross-sectional view of conventional planar inductor with a randomly-traced shield.
Figure 5B:
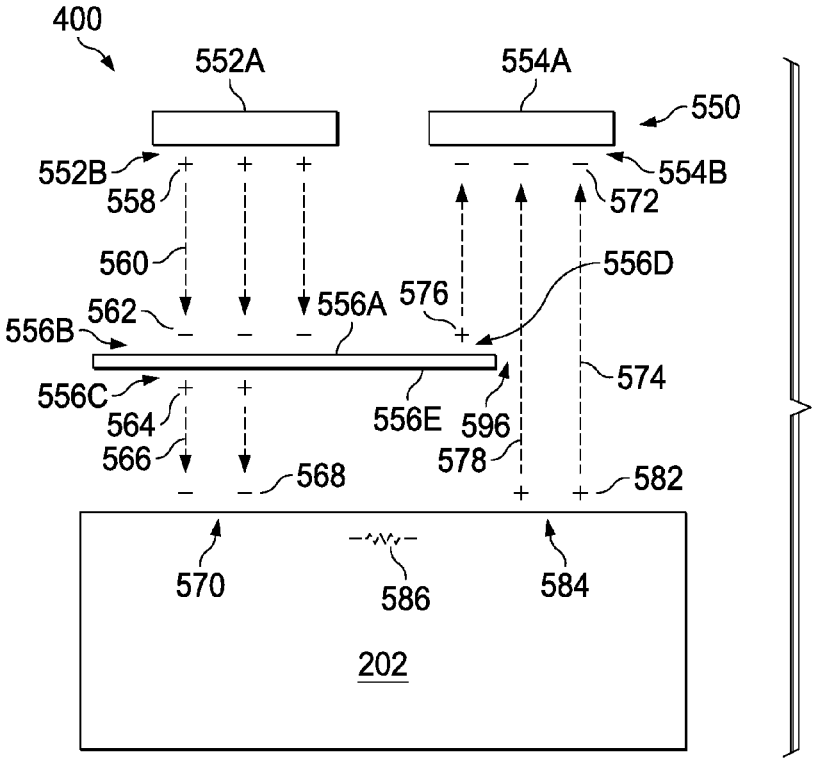
FIG. 5B (PRIOR ART)
FIG. 5B illustrates a cross-sectional view of conventional planar inductor with a random traced shield.

Returning to FIG. 4, trace portions 420, 422, 424, 426, 428, and 430 illustrate difficulties of conventional designs in providing shield traces disposed between the substrate and the trace. All the shield traces are not perpendicular to the main trace, do not extend continuously and are not symmetrical with respect to trace portion 420 and trace portion 426. Shield traces disposed below trace portions 420 and 426 remain perpendicular to trace portions 420 and 426 but some traces extend partially and some traces extend completely with a gap in the central location across the width of trace portions 420 and 426. Shield traces disposed below trace portions 422, 424, 428, and 430 are parallel, not perpendicular, to trace portions 422, 424, 428, and 430 and all traces do not extend completely below the width of trace portions 422, 424, 428, and 430. Gap 432 is located in a central location as illustrated in FIG. 5A while gap 434 as illustrated in FIG. 5B is located off center. Variation in balance, length, continuity and direction of shield traces across planar inductor 400 causes the electric field generated by the inductor traces to leak to the substrate causing image currents in the lossy substrate leading to Q degradation. Also since the shield traces are placed extremely close to each other, at high frequencies of operation, the shield traces capacitively couple to each other leading to flow of eddy currents and hence leading to further Q degradation.

The present invention is drawn to a planar inductor including a slotted metal shield of metal strips placed continuously, symmetrically and orthogonally to the positive and negative sides of the main inductor trace. With this construction, the differential nature of the inductor and shield balances the electric field terminating on the positive side and the negative side of the shield of the inductor. Due to this, most of the electric field gets confined in the space between the slotted metal shield and the main trace, thus significantly reducing the flow of image current in the lossy substrate. The metal strips width and spacing are optimized in such a way that the most of the electric field gets properly terminated on the shield and there are no significant eddy currents due to capacitive coupling between shield strips. All these effects improve the Q by greater than 50% over that of conventional planar inductors, when techniques in accordance with the present invention are applied to conventional planar inductors. The electrical and magnetic behavior of a slotted shield in accordance with aspects of the present invention will now be described in greater detail with reference to FIGS. 7A-B.

Figure 7A:
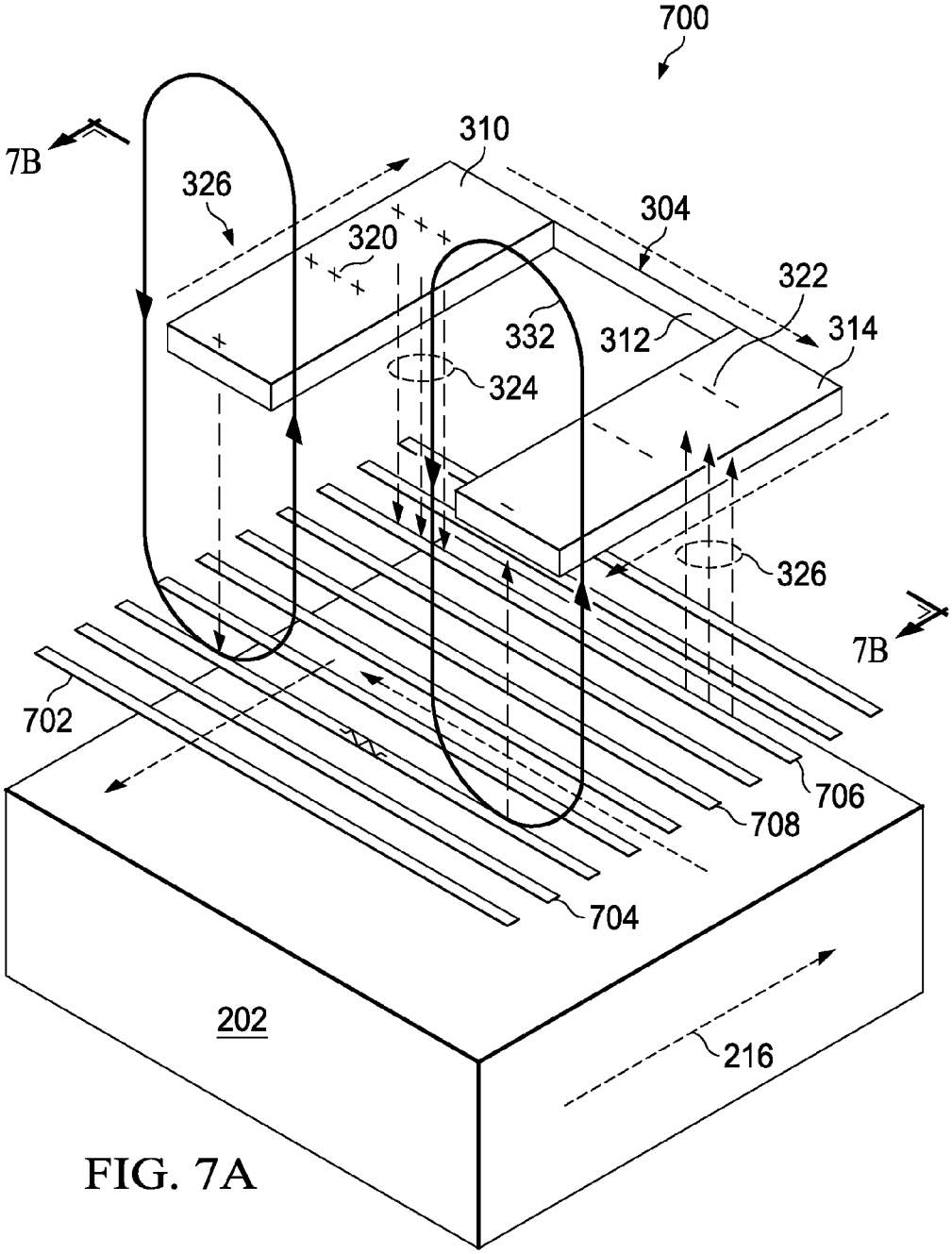
FIG. 7A illustrates partial oblique view of a planar inductor in accordance with aspects of the present invention.

FIG. 7A illustrates partial oblique view of a planar inductor in accordance with aspects of the present invention.

As shown in the figure, planar inductor 700 includes substrate 202, trace 304, and a slotted metal shield 702.

As shown in the figure, slotted metal shield 702 includes a plurality of traces, an example of which is indicated as a shield trace 704. Each trace within slotted metal shield 702 has a width 706 and is separated from a neighboring trace by a spacing 708. Slotted metal shield 702 is disposed between substrate 202 and trace 304.

Additionally shown in the figure are positive charge 320, negative charge 322, current 216, electric field 324, electric field 326, current 328 and magnetic flux 332.

In operation, current 328 flows from trace portion 310 through trace portion 312 toward trace portion 314. In the figure, consider current 328 at an instant, such that positive charge 320 accumulates within trace portion 310 causing electric field 324 between trace portion 310 and shield 702. Negative charge 322 accumulates within trace portion 314 causing electric field 326 between trace portion 314 and shield 702.

FIG. 7B explains the operation of the slotted metal shield. Electric field 324 from trace portion 310 and electric field 326 from trace portion 314 terminate on shield 702. Since shield 702 is continuous, symmetric from underneath the positive side of the inductor to the negative side of the inductor, electric field 324 and electric field 326 are exactly equal and opposite. Therefore electric field 324 balances electric field 326. Hence the charges induced by these electric fields cancel on shield 702 and the electric field is entirely confined between shield 702 and trace 304. Accordingly, no significant electric field goes to substrate 202. Therefore, image currents in substrate 202 are mitigated.

Since the metal shield strips are slotted and orthogonal to direction of the current flow, there is negligible image current in the shield. A metal shield strip is disposed such that a positive electric field, under the portion of the trace having a positive electric field in the direction toward the substrate, balances the negative electric field, under the portion of the trace having a negative electric field in the direction from the substrate. Since the metal shield is slotted, and is not a blanket metal shield, the eddy currents in the shield are negligible. Still further, the metal strips width and spacing may be optimized in such a way that the most of the electric field gets properly terminated on the shield and there are no significant eddy currents due to capacitive coupling between shield strips. For example, as the width of a metal strip decreases, there is an increased resistance to displacement current. On the other hand, as the width of the metal strip increases, there is an increase of eddy current loops in the shield strip, which degrades the Q. Further, as the spacing between the metal strips decreases, the capacitance between shield strips increases, which may provide shorts for eddy currents, which degrades the Q. On the other hand, as the spacing between the metal strips increases, there is less shielding such that more electric fields reach the substrate, generating heat and decreasing the Q.

Figure 2:
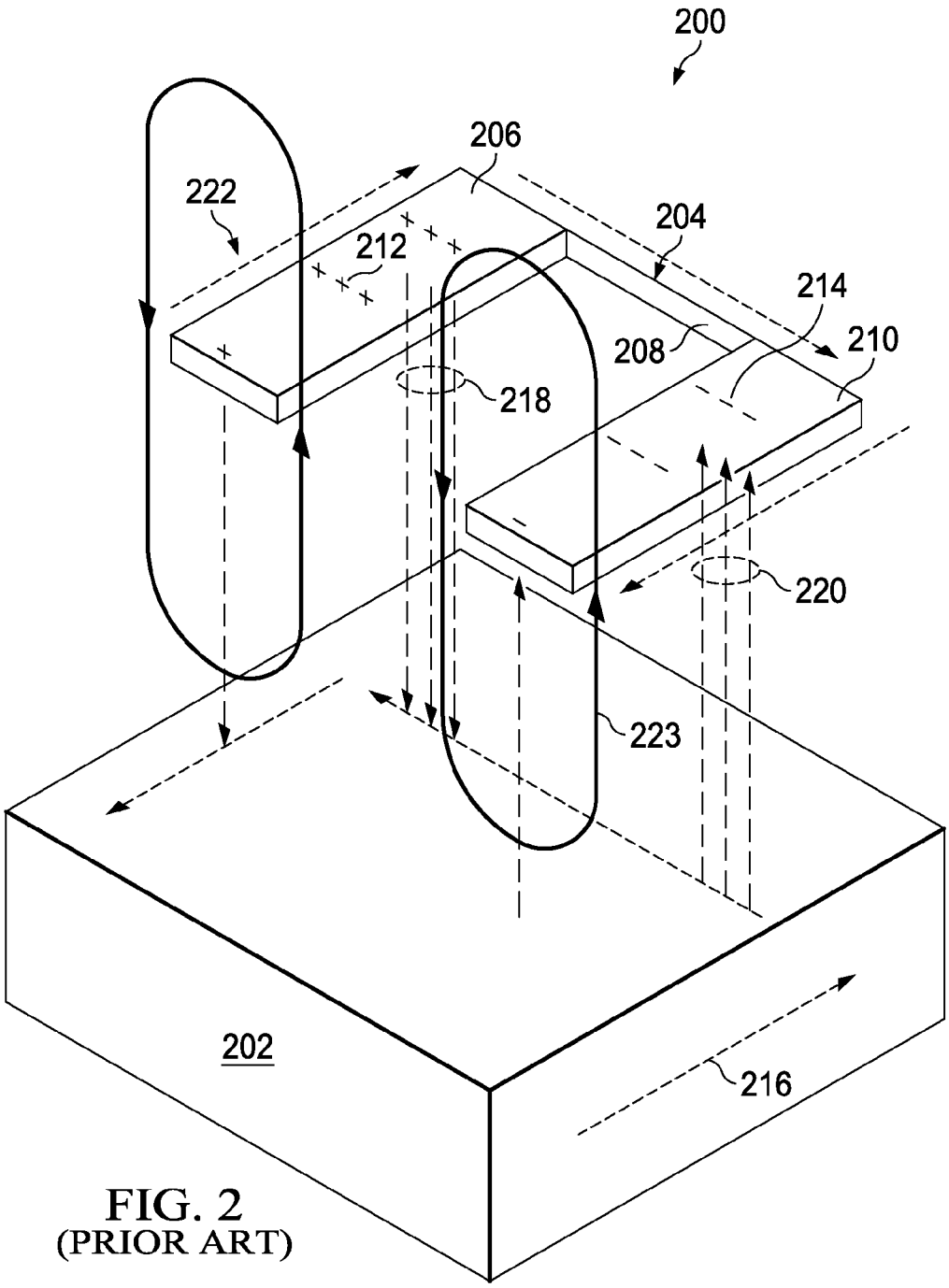
FIG. 2 (PRIOR ART)
FIG. 2 illustrates a partial cross sectional oblique view of a conventional planar inductor.
Figure 3A:
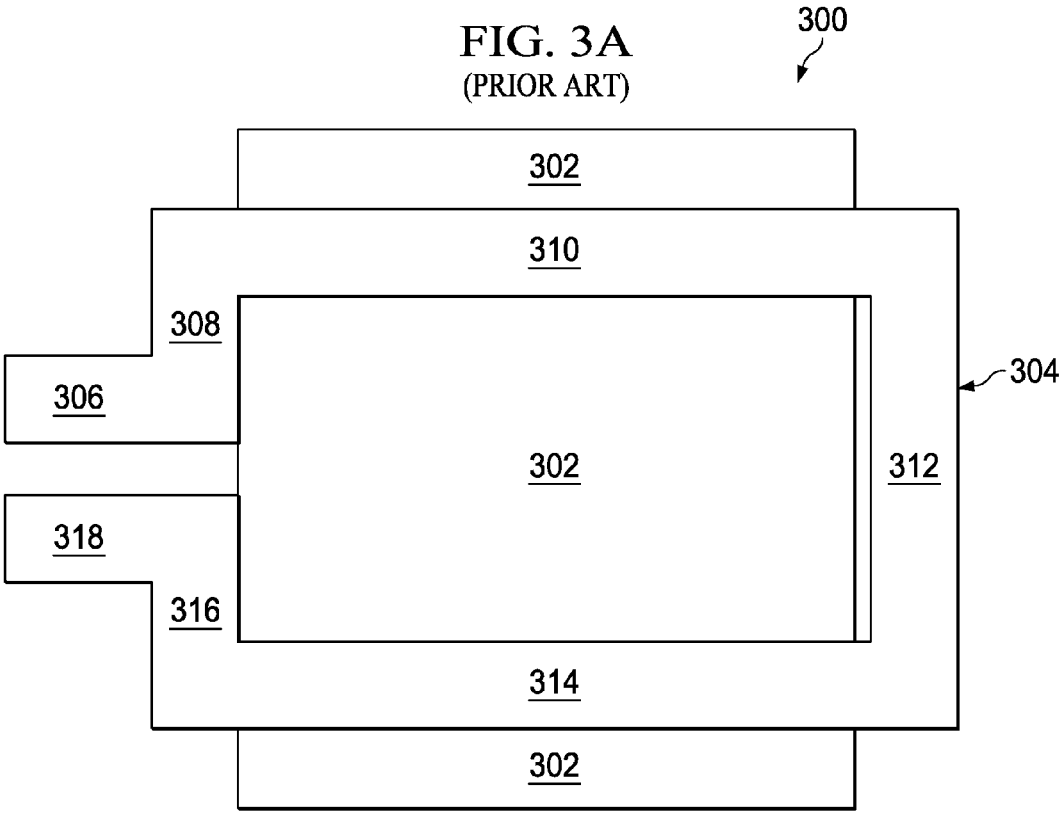
FIG. 3A (PRIOR ART)
FIG. 3A illustrates a top view of a conventional planar inductor.

The slotted metal shield confines most the E field between the shield and the inductor trace such that the image currents in the substrate are mitigated and the metal shield strips width and spacing are optimized in such a way that the eddy currents in the shield are mitigated. As a result, the Q factor of planar inductor 700 is higher than planar inductor 300 of FIG. 3B and planar inductor 200 of FIG. 2 because planar inductor 700 is less affected by eddy currents than planar inductor 300 and is less affected by image currents than planar inductor 200. Other geometric layouts of slotted metal shields may be used.

Figure 8:
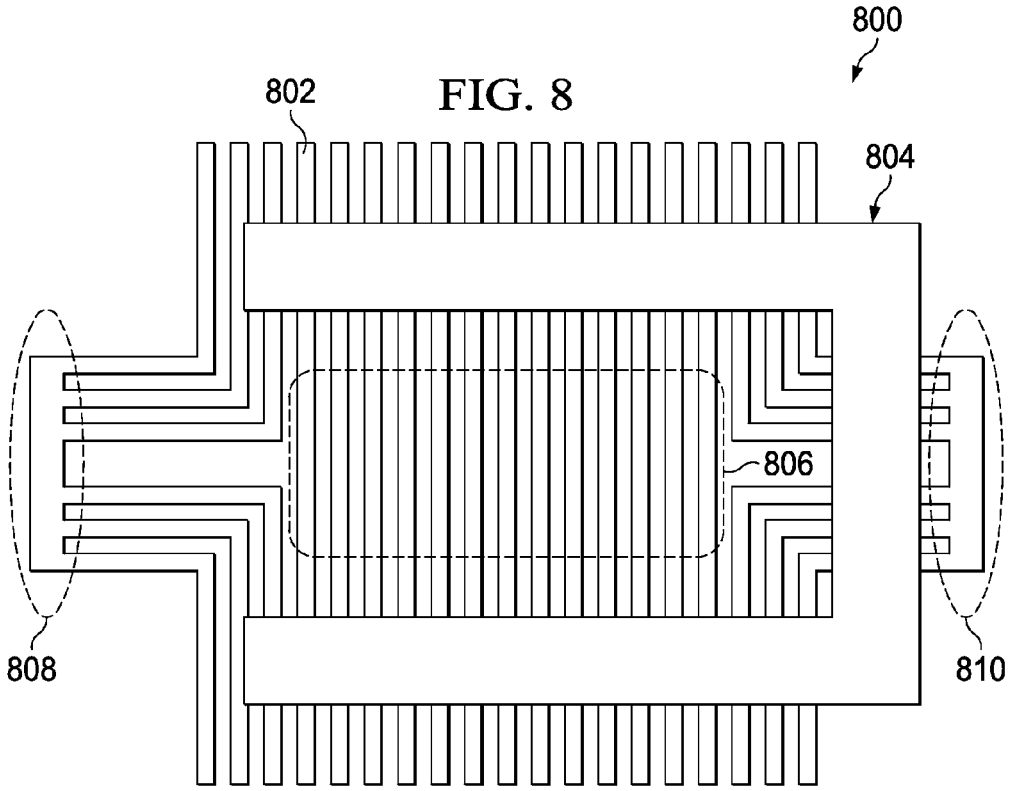
FIG. 8 illustrates another example planar inductor in accordance with aspects of the present invention

FIG. 8 illustrates another example planar inductor 800 in accordance with aspects of the present invention.

As shown in the figure, planar inductor 800 includes a substrate (not shown), a trace 804, and a slotted metal shield 802. In this example, the input and output portions of trace 804 are not shown. Slotted metal shield 802 is disposed between trace 804 and the substrate. Slotted metal shield 802 includes a portion 802 of parallel metal shield strips, a center portion 806 of metal shield strips, a portion 808 of metal shield strips and a portion 810 of metal shield strips. In this example, portion 808 and portion 810 have end structures that are connected together or electrically shorted to preserve symmetry. As such, the electric fields associated with the vertical portion of trace 804 and the electric fields associated with the input and output portions (not shown) of trace 804 are more easily balanced.

Figure 9:
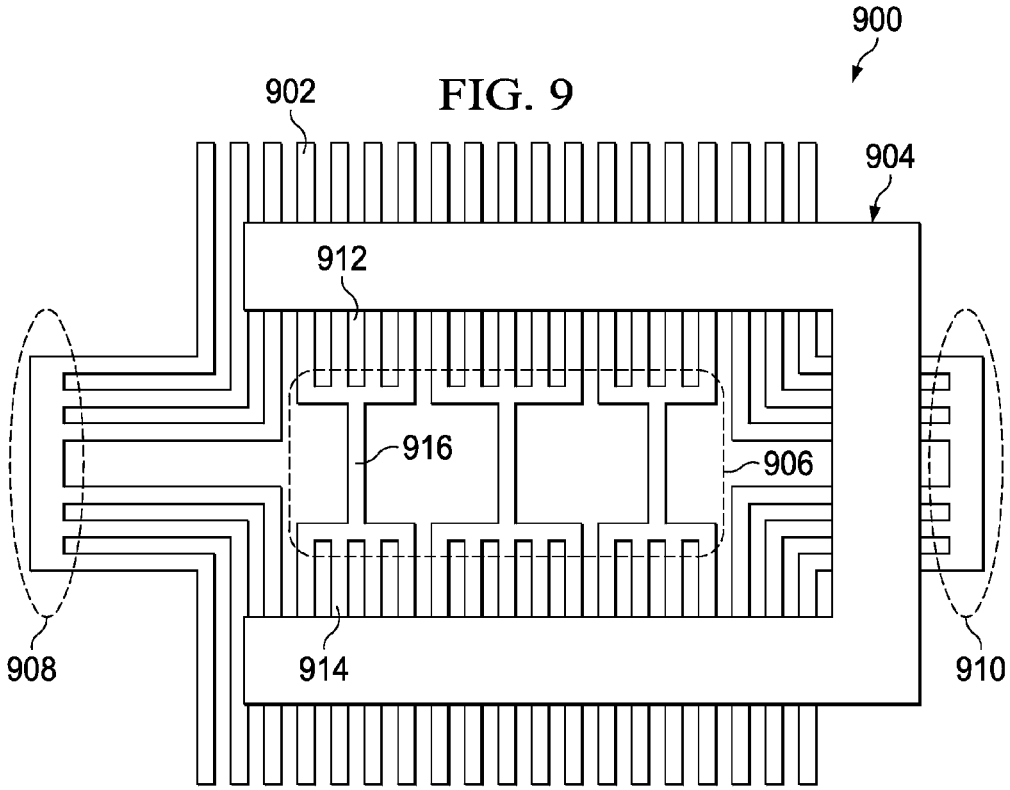
FIG. 9 illustrates another example planar inductor in accordance with aspects of the present invention

FIG. 9 illustrates another example planar inductor 900 in accordance with aspects of the present invention.

As shown in the figure, planar inductor 900 includes a substrate (not shown), a trace 904, and a slotted metal shield 902. In this example, the input and output portions of trace 904 are not shown. Slotted metal shield 902 is disposed between trace 904 and the substrate. Slotted metal shield 902 includes a portion 906 of groups of parallel metal shield strips, a portion 908 of metal shield strips and a portion 910 of metal shield strips. In this example, similar to planar inductor 800 discussed above, portion 908 and portion 910 have end structures that are shorted while preserving the properties of symmetry, orthogonality and continuity from positive side of the main trace to the negative side of the main trace. This modified shield structure enables a reduced area while implementing the inductor on silicon. Further, in this example, shield traces in portion 906 in the center of planar inductor 900 have been grouped into subgroups, examples of which are indicated as 912 and 914. Each subgroup is connected to an opposing subgroup via a single metal strip portion, an example of which is indicated as 916. Grouping the metal strips reduces the capacitive coupling between the metal strips in the shield and hence further improves the Q factor. This is an important benefit of bunching the metal strips while preserving the properties of symmetry, orthogonality and continuity from the positive side of the main trace to the negative side of the main trace.

Figure 10:
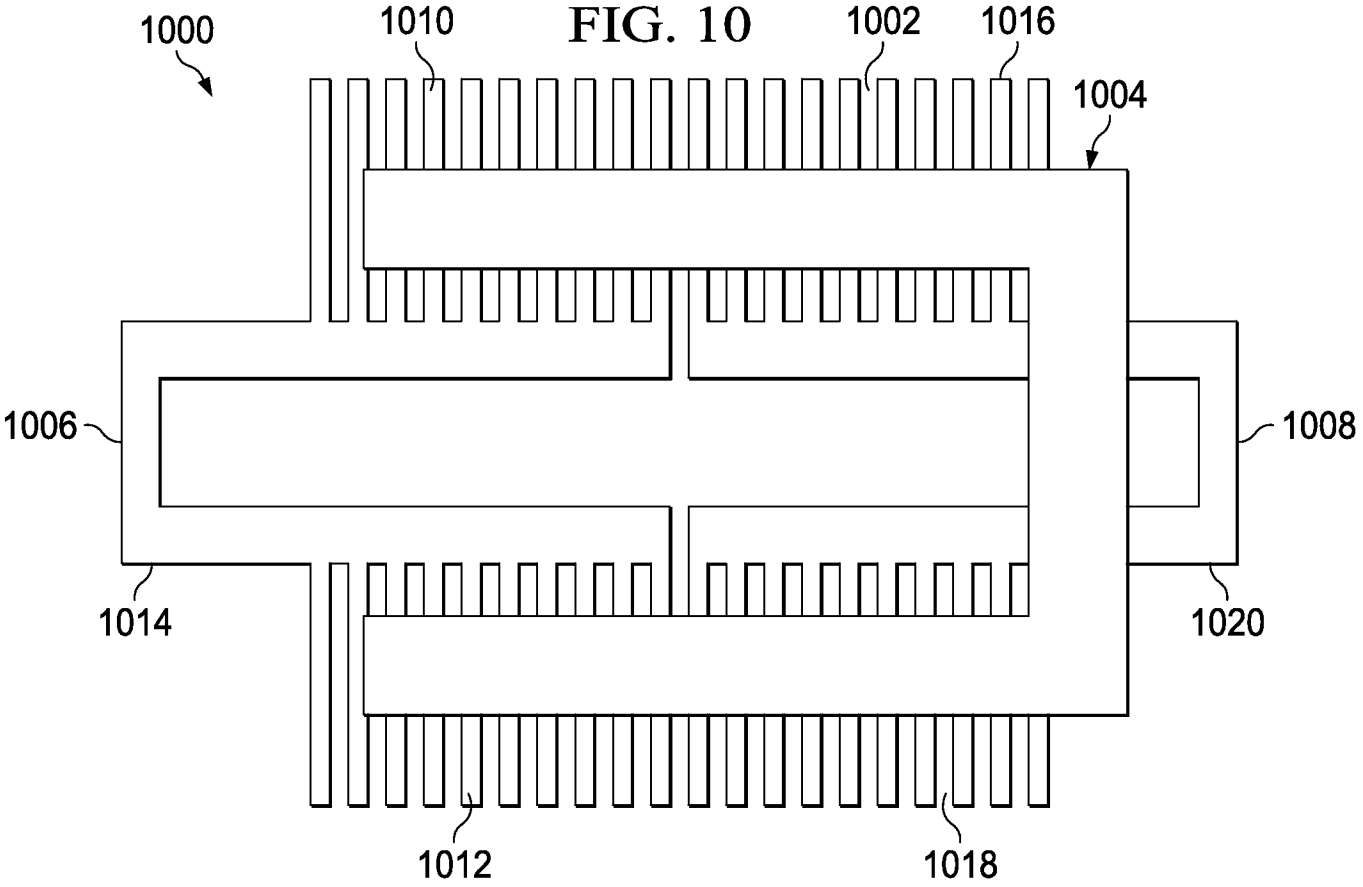
FIG. 10 illustrates another example planar inductor in accordance with aspects of the present invention.

FIG. 10 illustrates another example planar inductor 1000 in accordance with aspects of the present invention.

As shown in the figure, planar inductor 1000 includes a substrate (not shown), a trace 1004, and a slotted metal shield 1002. In this example, the input and output portions of trace 1004 are not shown. Slotted metal shield 1002 is disposed between trace 1004 and the substrate. Slotted metal shield 1002 includes a portion 1006 and a portion 1008 of metal shield strips. Portion 1006 includes a group 1010 of parallel metal strips, a group 1012 of parallel metal strips and a shorting portion 1014. Portion 1008 includes a group 1016 of parallel metal strips, a group 1018 of parallel metal strips and a shorting portion 1020.

Shorting portion 1014 ensures that the electric fields are balanced between group 1010 and group 1012. Shorting portion 1020 ensures that the electric fields are balanced between group 1016 and group 1018.

Changing the dimensions of the width of each trace, spacing between traces or the geometric layout of a slotted metal shield in accordance with aspects of the present invention may modify the resulting image currents within a substrate and the resulting eddy currents within the traces to achieve different Q factor.

Figure 11A:
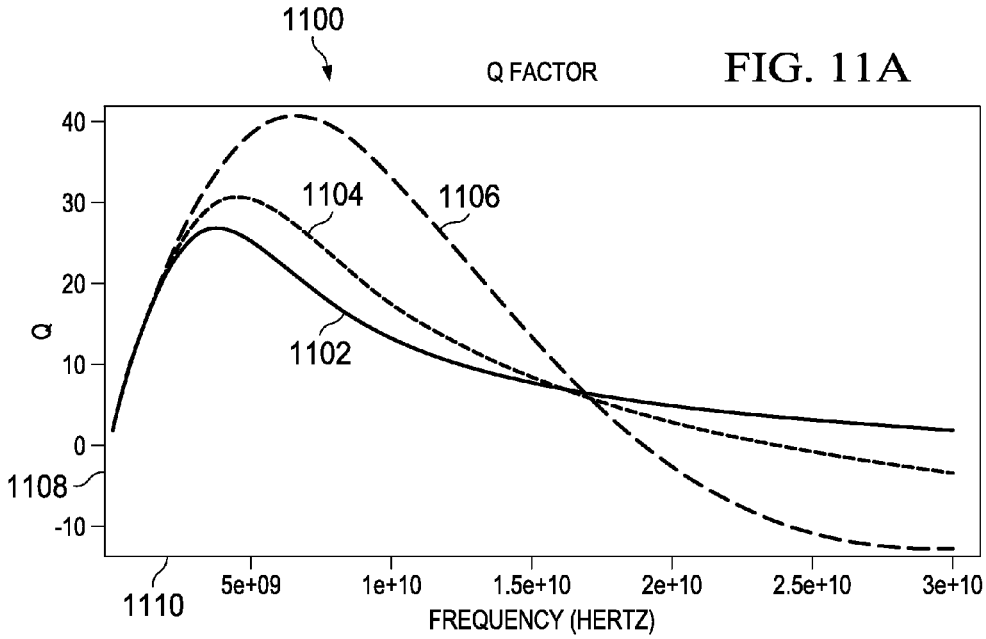
FIG. 11A illustrates a graph of a Q factor of planar inductors as a function of frequency.

FIG. 11A illustrates a graph of a Q factor of planar inductors as a function of frequency.

As shown in the figure, graph 1100 includes a function 1102, a function 1104, a function 1106, a y-axis 1108, and an x-axis 1110.

Figure 3B:
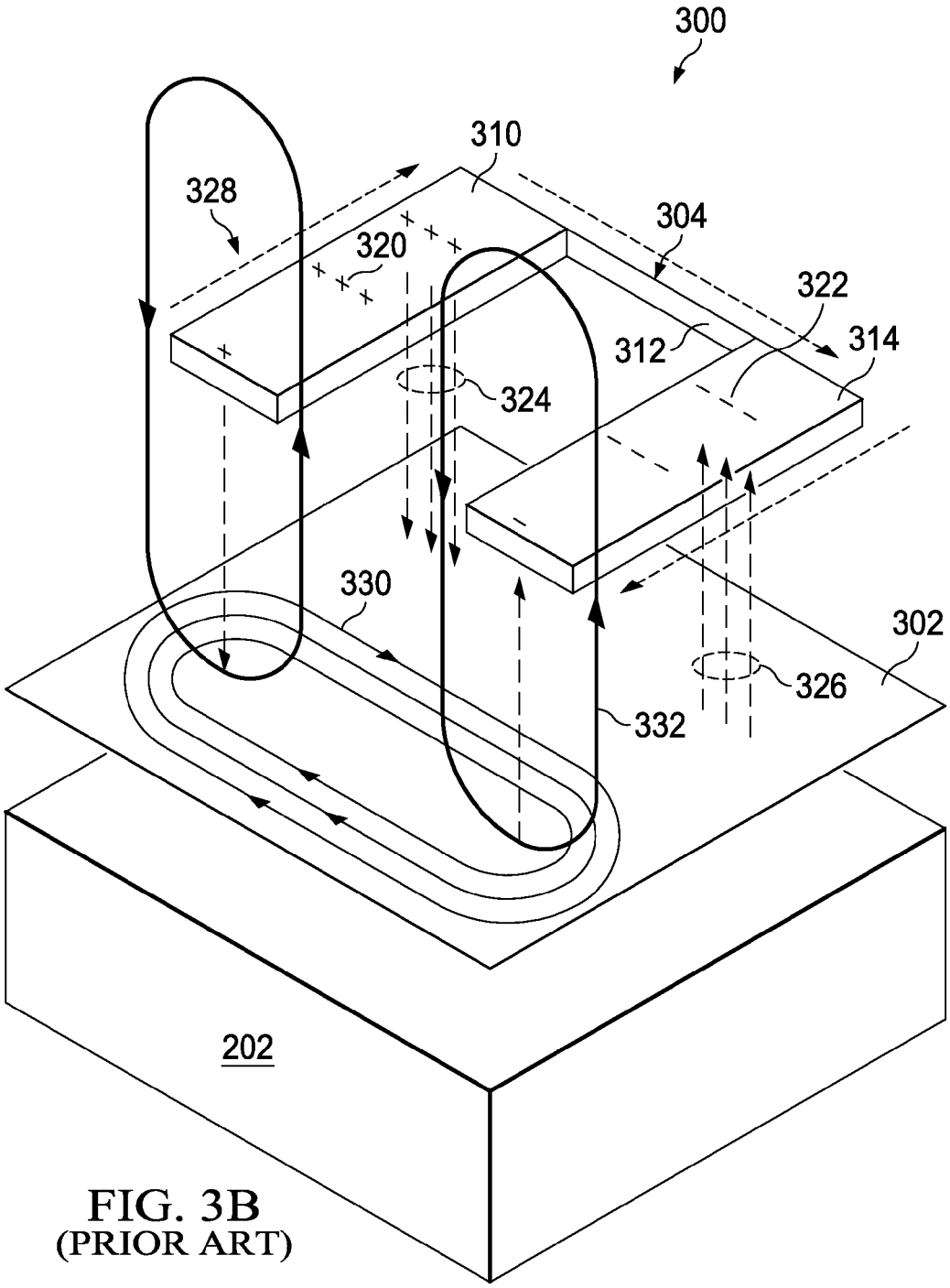
FIG. 3B (PRIOR ART)
FIG. 3B illustrates a partial cross sectional oblique view of a conventional planar inductor.

As shown in the figure: function 1102 corresponds to a Q factor of a planar inductor having a blanket metal shield similar to that of planar inductor 300 of FIG. 3B; function 1104 corresponds to a Q factor of a planar inductor having a slotted shield in accordance with aspects of the present invention; and function 1106 corresponds to a Q factor of another planar inductor having an slotted shield, in accordance with aspects of the present invention.

As shown by function 1102, the Q factor of the planar inductor having no metal shield has a maximum value of approximately 27.

The planar inductor corresponding to function 1104 is similar to planar inductor 600 of FIG. 6, wherein the shield trace spacing 630 is 0.44 μm and the trace width 632 is 0.44 μm. As indicated by function 1104, such a planar inductor has a Q factor maximum of approximately 31, approximately a 15% improvement over the planar inductor having no metal shield.

The planar inductor corresponding to function 1106 is additionally similar to planar inductor 600 of FIG. 6, wherein the shield trace spacing 630 and the trace width 632 are each 0.88 μm. As indicated by function 1106, such a planar inductor provides a maximum Q factor of 40, approximately a 30% improvement over the planar inductor having no metal shield.

Figure 11B:
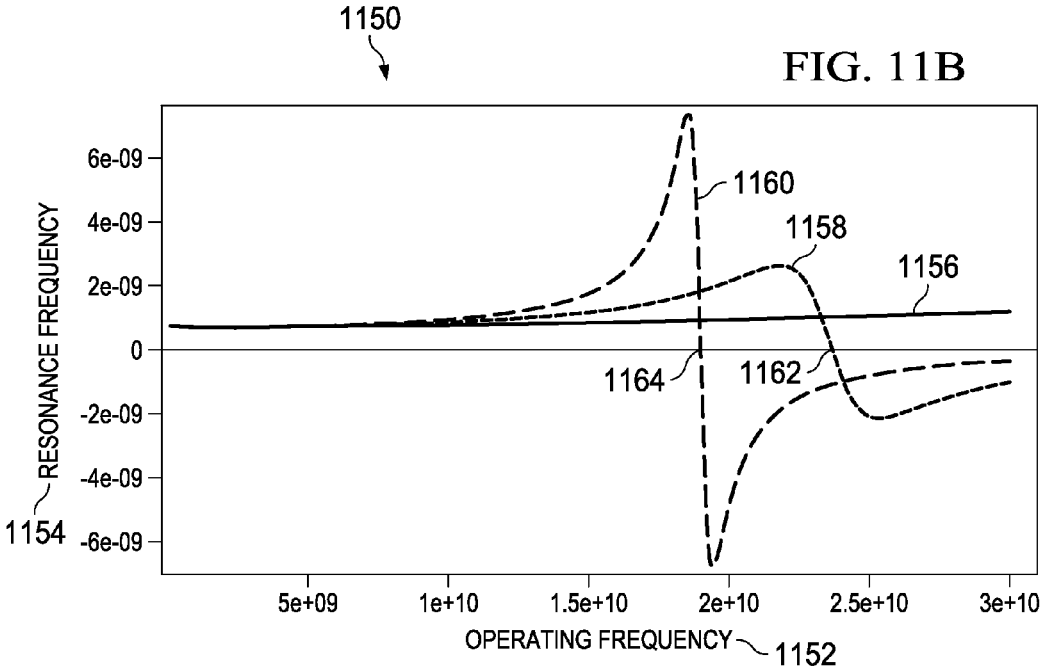
FIG. 11B illustrates a graph of crossover and resonance of planar inductors as a function of frequency

FIG. 11B illustrates a graph 1150 of resonance frequency as a function of operating frequency.

As shown in the figure, graph 1150 includes an x-axis 1152 and a y-axis 1154, a function 1156, a function 1158, and a function 1160. Additionally, graph 1150 includes a data point 1162 and a data point 1164.

Function 1156 represents a resonance frequency of a planar inductor having a blanket metal shield similar to that of planar inductor 300 of FIG. 3B. Function 1158 represents a resonance frequency response to a planar inductor similar to planar inductor 600 of FIG. 6, wherein the shield trace spacing 630 is 0.44 μm and the trace width 632 is 0.44 μm. Function 1160 represents frequency response to a planar inductor similar to planar inductor 600 of FIG. 6, wherein the shield trace spacing 630 is 0.88 μm and the trace width 632 is 0.88 μm. Point 1162 represents a crossover for function 1158. Point 1164 represents a crossover for function 1160.

A crossover occurs at a resonance frequency, where the inductance value changes from a positive value to a negative value, i.e., the function has an x-axis intercept. Resonance occurs during operation of an inductor because magnetic field stored in the inductor gets exchanged as electric field in the capacitance across the inductor. Energy moves between electric and magnetic fields and creates an oscillation frequency called resonance frequency.

A function with values on the positive y-axis indicates that the inductor acts as an inductor. A function with values on the negative y-axis indicates that the inductor acts as a capacitor. Function 1156 performs as an inductor since it has positive values only. Functions 1158 and 1160 can perform as both inductors (positive) and capacitors (negative) since they contain positive and negative values.

The frequency curve for an inductor without shield, function 1156, does not result in a crossover but maintains a positive value only. Function 1158 has a crossover at point 1162 which corresponds to a resonance frequency of 24 GHz. As such, a planar inductor corresponding to function 1162 will act as an inductor up to 24 GHz, but will act as a capacitor at frequencies higher than 24 GHz. Function 1160 has a crossover frequency at point 1164 which corresponds to a resonance frequency of 18 GHz. As such, a planar inductor corresponding to function 1164 will act as an inductor up to 18 GHz, but will act as a capacitor at frequencies higher than 18 GHz.

The aspect discussed above deals with a slotted shield wherein shield traces perpendicular to current in the current trace reduce, if not eliminate eddy and image currents, and increase the Q factor of the planar inductor. However, shown in FIG. 11B, a planar inductor having a particularly designed slotted shield, white increasing the Q factor, will have an associated resonant frequency.

For example, the planar inductor associated with function 1106 in FIG. 11A and function 1160 in FIG. 11B, has a maximum Q factor of 40 at about 7 GHz but has a resonant frequency at 18 GHz. Similarly, the planar inductor associated with function 1104 in FIG. 11A and function 1158 in FIG. 11B, has a maximum Q factor of 32 at about 4 GHz but has a resonant frequency at 24 GHz.

In general, all circuits that use inductors and capacitors in resonant tanks would require tuning of the resonant frequency to make the circuit performance robust across process variations. Also, in some circuits, the resonant frequency of LC tanks needs to be changed based on a low frequency modulating signal, this mechanism being called frequency modulation.

In accordance with another aspect of the present invention, the resonant frequency of a planar inductor may be shifted. For example, using the example situation discussed above, the resonant frequency of the planar inductor associated with function 1106 in FIG. 11A and function 1160 in FIG. 11B, may be shifted to meet the circuit design requirement of a resonant frequency greater than 18 GHz. In particular, in accordance with this aspect of the present invention, the frequency of the inductor may be timed using an additional slotted shield. The additional slotted shield may include a first controllable metal trace connected to a second controllable metal trace via a switch. The metal traces are controllable by opening/closing the switch. This aspect of the present invention will now be described with additional reference to FIGS. 12-15.

Figure 12:
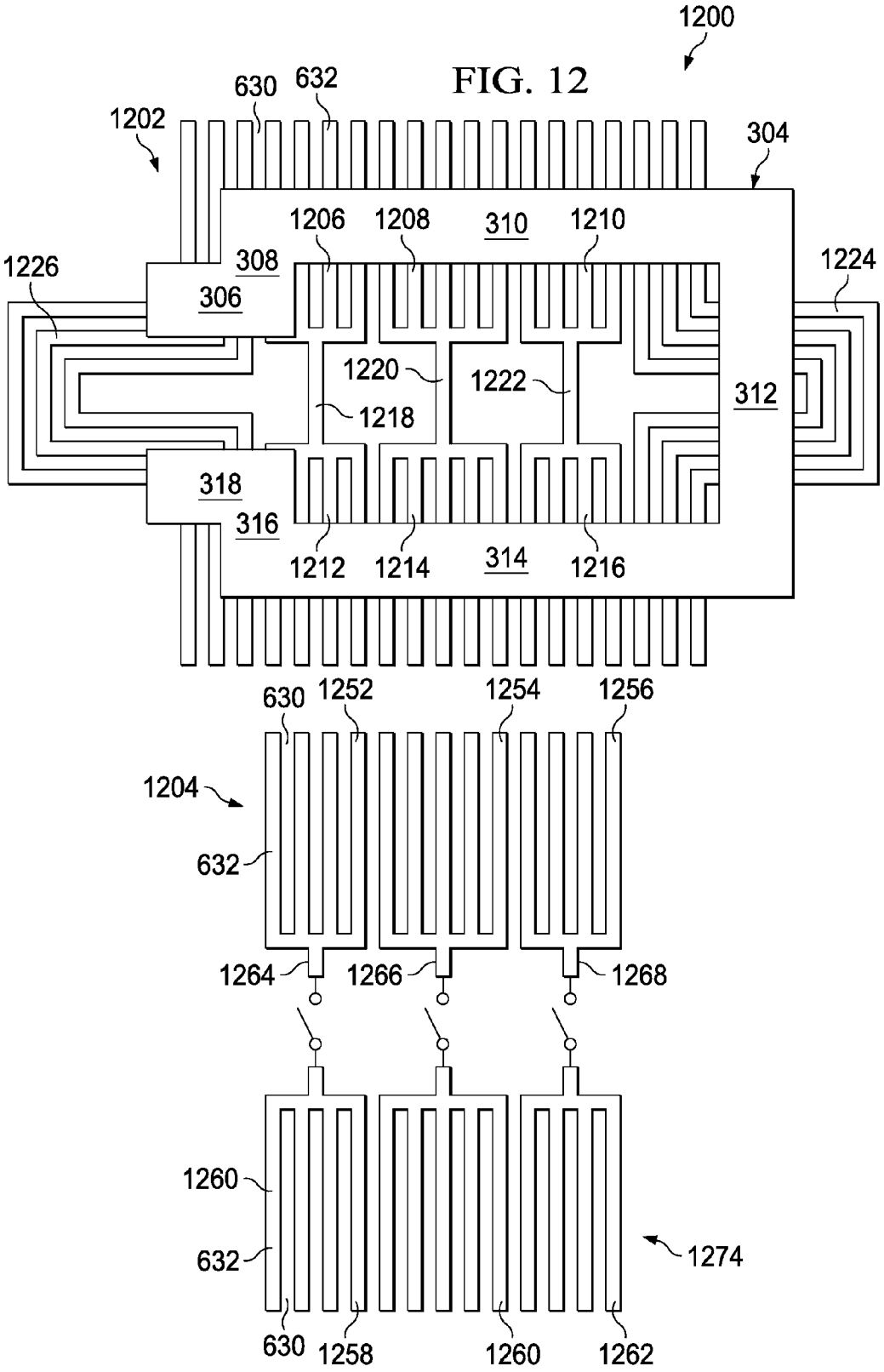
FIG. 12 illustrates a frequency-tunable planar inductor in accordance with aspects of the present invention.

FIG. 12 illustrates a planar inductor 1200 having an increased Q factor in addition to the ability to tune its resonance frequency in accordance with aspects of the present invention.

As shown in the figure, a frequency tunable planar inductor 1200 includes a substrate (not shown), trace 304, a first slotted metal shield 1202, and a slotted metal shield 1204.

Slotted metal shield 1202 includes shield trace dimension 630 for the spacing between adjacent traces and shield trace dimension 632 for the width of each slot. Slotted metal shield 1202 includes a shield portion 1206, a shield portion 1208, a shield portion 1210, a shield portion 1212, a shield portion 1214, a shield portion 1216, a shield portion 1218, a shield portion 1220, a shield portion 1222, a shield portion 1224, and a shield portion 1226.

Shield portion 1206 is connected to shield portion 1212 via shield portion 1218. Shield portion 1208 is connected to shield portion 1214 via shield portion 1220. Shield portion 1210 is connected to shield portion 1216 via shield portion 1222.

Slotted metal shield 1204 includes a shield portion 1252, a shield portion 1254, a shield portion 1256, a shield portion 1258, a shield portion 1260, a shield portion 1262, a shield switch portion 1264, a shield switch portion 1266 and a shield switch portion 1268.

Shield portion 1252 is connectible to shield portion 1258 via shield switch portion 1264. Shield portion 1254 is connectible to shield portion 1260 via shield switch portion 1266. Shield portion 1256 is connectible to shield portion 1260 via shield portion 1220.

Each trace within slotted metal shield 1204 is separated from a neighboring trace by a spacing 630. Further, each trace has a width 632.

It should be noted that slotted metal shield 1204 is shown next to slotted metal shield 1202 and trace 304 merely to provide a better view of slotted metal shield 1204. In actuality, slotted metal shield 1202 is disposed between slotted metal shield 1204 and substrate (not shown), whereas slotted metal shield 1204 is disposed between trace 304 and slotted metal shield 1202.

As shown in the figure, slotted planar inductor 1200 includes inductor trace 304. Planar inductor 1202 includes traces that are perpendicular to image current during operation, for the largest Q factor. Planar inductor 1202 additionally includes shield portions 1218, 1220, and 1222, which connect portion 1206 to portion 1212, portion 1208 to portion 1214, and portion 1210 to portion 1216. Portions 1218, 1220, and 1222 maintain continuity of trace portions 1206 to 1212, 1208 to 1214, and 1210 to 1216. Shield 1204 also includes traces that are perpendicular to image current during operation, for an increased Q factor, similar to shield 1202. Shield 1204 also includes switches 1264, 1266, and 1268. When switches 1264, 1266, and 1268 are closed, contact is made between shield portions 1252 and 1258, 1254 and 1260, and 1256 and 1262.

When switches 1264, 1266, and 1268 are open, shield 1204 acts in a manner similar to the shield discussed above in FIG. 5A. Accordingly, the electric field passes through shield 1204 to shield 1202. In such a case, shield 1202 acts as the primary shield and the electric field terminates thereon, in a manner similar to planar inductor 700 of FIG. 7B. The intervention of shield 1204 on the electric field does not affect the Q factor. As such, planar inductor 1200 will have a different Q factor similar to that of planar inductor 700 of FIG. 7, when switches 1264, 1266 and 1268 are open.

When switches 1264, 1266, and 1268 are closed, the electric field from trace 304 terminates on shield 1206, in a manner similar to planar inductor 700 of FIG. 7B. In this situation, the portions of shield 1202 that lie below shield 1204 will have no effect on the Q factor. Because shield 1204 is disposed at a closer distance to trace 304 than shield 1202, the electric field terminating on the shield 1204 is larger than the electric field that would have terminated in shield 1202 if shield 1204 was either absent or the switches in shield 1204 are open. As such, when switches 1264, 1266 and 1268 are closed, shield 1204 will provide a different Q factor.

The Q factor of planar inductor 1200 may be changed by varying switching configuration, i.e., providing different combinations of opening/closing of switches 1264, 1266 and 1268. Each change in the Q factor may shift the overall resonant frequency of the planar inductor.

In other words, shield 1204 provides a mechanism for changing the resonant frequency by opening and closing switches 1264, 1266, and 1268. Closing switches isolates substrate from electric fields reduces image currents within the lossy substrate. Closing switches also changes inductor resistance and capacitance which changes resonant frequency. The concept of using multiple switches is expanded further in the following example.

Figure 13:
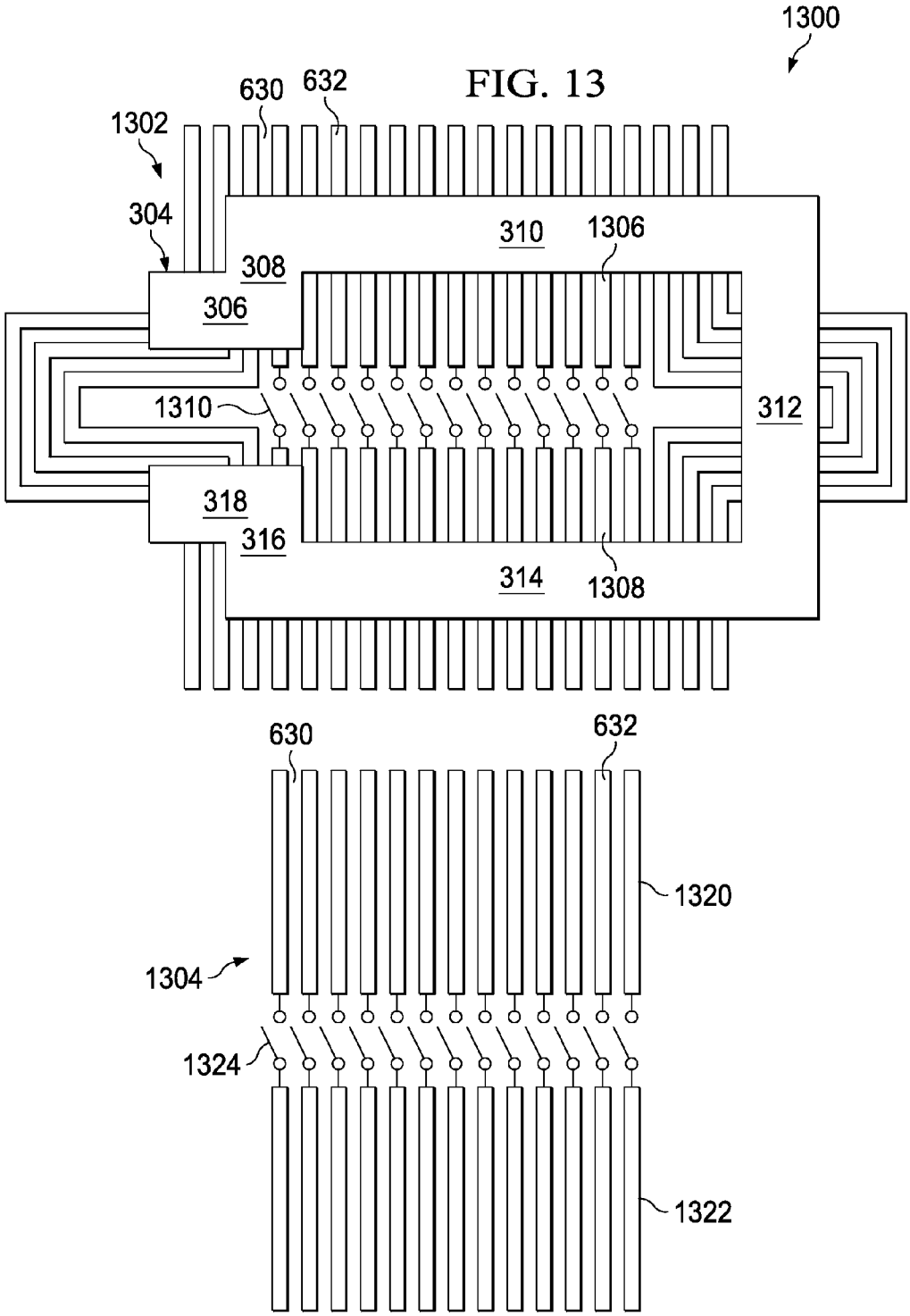
FIG. 13 illustrates another frequency-tunable planar inductor in accordance with aspects of the present invention.

FIG. 13 illustrates another multiple shield frequency-tunable planar inductor in accordance with aspects of the present invention.

As shown in the figure, a frequency-tunable planar inductor 1300 includes trace 304, a slotted metal shield 1302, and a slotted metal shield 1304.

As shown in the figure, a switch array shield portion 1310 is disposed within slotted metal shield 1302. Slotted metal shield 1302 includes a shield portion 1306 connected to a shield portion 1308 by switch array shield portion 1310. Slotted metal shield 1304 includes a shield portion 1320 connected to a shield portion 1322 by a switch array shield portion 1324. Slotted metal shield 1302 and slotted metal shield 1304 include a dimension 630 for spacing between adjacent traces and a shield dimension 632 for trace width.

Slotted metal shield 1304 is disposed between slotted metal shield 1302 and trace 304. Slotted metal shield 1302 is disposed between shield 1304 and substrate (not shown).

In operation, switch arrays 1310 and 1324 are closed allowing electrical contact (not shown) across slotted metal shield 1302 and slotted metal shield 1304. Individual switches within switch arrays 1310 and 1324 can be turned on and off to allow changes to modulation frequency. Opening and closing switching arrays 1310 and 1324 changes the strength of the electric field terminating on the respective shields and hence changes the capacitance associated with the inductor. By varying the strength of the electric field terminating in the metal shield by closing or opening the switches as in FIG. 12, FIG. 13 provides a further ability to modulate frequency of planar inductor with finer control of resistance and capacitance of individual traces.

FIG. 14 illustrates cross-sectional view of a tunable-frequency planar inductor in accordance with aspects of the present invention.

As shown in the figure, tunable-frequency planar inductor 1400 includes a trace 1402, a slotted metal shield 1404, a slotted metal shield 1406 and a substrate 202.

Trace 1402 includes a trace portion 1408A and trace portion 1410A. Trace portion 1408A includes a surface 1408B and trace portion 1410A includes a surface 1410B.

Slotted metal shield 1404 includes a switch 1412. Slotted metal shield 1406 includes a portion 1406A, a portion 1406B and a switch 1414. In this example, switch 1412 and 1414 are closed.

Additionally shown are a positive charge 1416, an electric field 1418, a negative charge 1420, a negative charge 1422, an electric field 1424 and a positive charge 1426.

Slotted metal shield 1404 is disposed between slotted metal shield 1406 and substrate 202, whereas and slotted metal shield 1406 is disposed between trace 1402 and slotted metal shield 1404.

In operation, a current through trace 1402 creates a positive charge 1416 surface 1408B, which generates electric field 1418 in a direction toward surface 1406A. Electric field 1418 induces negative charge 1420 on surface 1406A. The current through trace 1402 additionally creates negative charge 1422 on surface 1410B, which generates electric field 1424 in a direction from surface 1406B. Electric field 1424 induces positive charge 1426 on surface 1406B. In this manner, slotted metal shield 1406 acts in a manner similar to metal shield 702 discussed above with reference to FIG. 7B.

FIG. 14 illustrates charge behavior for FIG. 12 and FIG. 13. Shield 1404 represents shield 1202 for trace portions and shield 1302 for individual switches. Shield 1406 represents shield 1204 for trace portion switches and shield 1304 for individual trace switches. When switches in FIG. 12 and switching array in FIG. 13 are closed, their behavior is similar to shield 1406 in FIG. 14. When switches are open, their behavior is similar to shield 702 in FIG. 7.

A further enhancement of the Q factor can be realized for two turn (2-T) planar inductors. An example 2-T planar inductor may include a conductive trace having an input port, a first portion, a first crossover, a second portion, a third portion and an output port.

FIG. 15 illustrates a 2-T planar inductor 1500 in accordance with aspects of the present invention.

As shown to the figure, a 2-T planar inductor 1500 includes a trace 1504 and a slotted metal shield 1506. Trace 1504 includes an input port 1507, a trace portion 1508, a trace portion 1510, a trace portion 1512, a crossover 1514, a cross-under 1516 and an output port 1509. Slotted metal shield 1506 includes a shield portion 1518, a shield portion 1520, and a shield portion 1522. Slotted metal shield 1506 is disposed between trace 1504 and substrate (not shown). Trace portion 1512 forms a loop connected to trace portion 1510 by crossover 1514 which is also connected to trace portion 1508 by cross-under 1516.

In this example, a first portion may be trace portion 1508, the first crossover may be the combination of crossover 1514 and cross-under 1516, the second portion may be trace portion 1512 and the third portion may be trace portion 1510.

In operation, current flows between trace 1504 and trace portions 1510, 1512, 1514, and 1516. A magnetic field (not shown) is generated perpendicular to planar inductor 1500.

Trace portions 1508 and 1510 form a single turn inductor and trace loop portion 1512 forms another single turn inductor.

Planar inductor with traced shield only slightly improves the Q factor. Because electric field in random traced shield still terminates on portions of substrate because of unbalanced traces, residual image current degrades the Q factor. By balancing slotted shield across inductor trace and substrate, balanced slotted shield confines electric field between shield and inductor and image current in substrate is reduced, if not eliminated. Maintaining orthogonality between direction of image current and balanced traces, reduces, if not eliminates, image current within shield. The Q factor is maximized without loss due to image current loss.

Multiple shield planar inductors use switches to connect shield portions to vary the length of a shield portion and switching arrays to connect shield traces to vary the length of an individual shield slot. By varying shield portion length, a shield can be used to tune resonant and center frequency. By varying shield trace length, a shield can be used to modulate frequency.

In addition, the present invention allows the ability to vary resonance frequency by tuning operating frequency and with increased Q maximum.

The foregoing description of various preferred embodiments of the invention have been presented for purposes of illustration and description. It is not intended to be exhaustive or to limit the invention to the precise forms disclosed, and obviously many modifications and variations are possible in light of the above teaching. The exemplary embodiments, as described above, were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed as new and desired to be protected by Letters Patent of the United States is:

1. An integrated circuit comprising:

A. a semiconductor substrate having a top surface;

B. a substantially rectangular, planar, conductive metal trace above the top surface of the substrate, the conductive metal trace including first and second conductive portions substantially parallel with and spaced from one another, a third conductive portion substantially perpendicular and connecting together the first and second portions, a fourth conductive input portion connected to the first conductive portion opposite the third portion, and a fifth conductive output portion connected to the second conductive portion opposite the third portion and spaced from the fourth portion; and C. shield traces formed spaced between the top surface of the substrate and the conductive metal trace, the shield traces being spaced from one another and the shield traces including:

a center shield portion of continuously parallel shield traces extending under, beyond, and perpendicular to the first and second conductive traces within the rectangular conductive metal trace, and a first side shield portion of continuously parallel shield traces, the first side shield portion of traces including first and second side portions extending under, beyond, and substantially perpendicular to the first and second conductive portions and substantially parallel with the shield traces of the center shield portion, the first side shield portion of traces including third side portions extending under, beyond and substantially perpendicular to the third conductive portion, and the first side shield portion including fourth side portions connecting together the third side portions substantially parallel with the third conductive portion and outside of the rectangular conductive metal trace.

2. The integrated circuit of claim 1 in which the conductive trace has a width of substantially 36 μm.

3. The integrated circuit of claim 1 in which the shield traces have a width of substantially 0.88 μm and a spacing between shield traces of substantially 0.88 μm.

4. The integrated circuit of claim 1 in which the conductive metal trace is an inductor.

* * * * *